US011027450B2

(12) United States Patent
Gereg

(10) Patent No.: US 11,027,450 B2
(45) Date of Patent: Jun. 8, 2021

(54) CUTTING HEADS, CUTTING MACHINES EQUIPPED THEREWITH, AND METHODS OF OPERATION

(71) Applicant: URSCHEL LABORATORIES, INC., Chesterton, IN (US)

(72) Inventor: Dustin Joseph Gereg, Lowell, IN (US)

(73) Assignee: Urschel Laboratories, Inc., Chesterton, IN (US)

( * ) Notice: Subject to any disclaimer, the term of this patent is extended or adjusted under 35 U.S.C. 154(b) by 0 days.

(21) Appl. No.: 16/732,478

(22) Filed: Jan. 2, 2020

(65) Prior Publication Data

US 2020/0206964 A1 Jul. 2, 2020

Related U.S. Application Data

(60) Provisional application No. 62/787,568, filed on Jan. 2, 2019.

(51) Int. Cl.
*B26D 7/06* (2006.01)
*B26D 1/03* (2006.01)
(Continued)

(52) U.S. Cl.
CPC ..... *B26D 7/2614* (2013.01); *B26D 1/03* (2013.01); *B26D 1/34* (2013.01); *B26D 7/0691* (2013.01);
(Continued)

(58) Field of Classification Search
CPC ..... B26D 2210/02; B26D 7/2614; B26D 7/2628; B26D 1/34; B26D 7/0691; B26D 1/03
See application file for complete search history.

(56) References Cited

U.S. PATENT DOCUMENTS 3,139,128 A 6/1964 Urschel et al.
3,139,129 A 6/1964 Urschel et al.
(Continued)

FOREIGN PATENT DOCUMENTS

EP 3412418 12/2018
JP 2017108702 6/2017

OTHER PUBLICATIONS

International Search Report and Written Opinion for PCT/US2020/012015, dated Apr. 29, 2020, (10 pages).

*Primary Examiner* — Sean M Michalski
(74) *Attorney, Agent, or Firm* — Hartman Global IP Law; Gary M. Hartman; Domenica N. S. Hartman

(57) ABSTRACT

Cutting heads and machines equipped therewith. The cutting heads include axially-spaced annular-shaped structural members and circumferentially-spaced support segments between the structural members. Each support segment has a leading edge and a trailing edge, a knife support surface defined on an inner surface region adjacent the leading edge of the support segment, and a gate located adjacent the trailing edge of the support segment. A knife assembly is located adjacent the leading edge of each support segment. Each knife assembly includes a holder opposing one of the knife support surfaces of the support segments and adapted to clamp a knife between the holder and knife support surface. The cutting head may further have camming units that secure the support segments between the structural members, camming units that clamp the knives to the knife support surfaces, and/or adjustment pins that deflect the gates of the support segments.

31 Claims, 31 Drawing Sheets

(51) Int. Cl.
*B26D 1/34* (2006.01)
*B26D 7/26* (2006.01)

(52) U.S. Cl.
CPC ..... *B26D 7/2628* (2013.01); *B26D 2210/02* (2013.01)

(56) References Cited

U.S. PATENT DOCUMENTS 4,523,503 A * 6/1985 Julian ..... B26D 1/03 83/403
5,095,875 A * 3/1992 Morris ..... B26D 1/0006 83/403
5,694,824 A 12/1997 Jacko et al.
6,968,765 B2 * 11/2005 King ..... B26D 7/0691 83/403
7,658,133 B2 2/2010 Jacko et al.
8,161,856 B2 * 4/2012 Jacko ..... B26D 1/03 83/403
9,193,086 B2 * 11/2015 Jacko ..... B26D 7/0691
9,469,041 B2 10/2016 King et al.
10,456,943 B2 10/2019 King et al.
10,632,640 B2 * 4/2020 Bucks ..... B26D 7/0691
10,780,602 B2 * 9/2020 Gereg ..... B26D 1/03
2002/0029673 A1 * 3/2002 Arrasmith ..... B26D 7/06 83/145
2002/0170991 A1 11/2002 Prewitt et al.
2010/0015312 A1 * 1/2010 Bellmunt-Molins ..... B26D 7/0691 426/518
2014/0090536 A1 * 4/2014 Ornelaz, Jr. ..... B26D 7/2614 83/698.11
2014/0290451 A1 10/2014 Jacko et al.
2016/0067877 A1 * 3/2016 Cogan ..... B26D 7/2614 83/13
2016/0158953 A1 * 6/2016 King ..... B26D 7/08 83/13
2016/0361831 A1 12/2016 Fant
2018/0126581 A1 * 5/2018 Jacko ..... B26D 7/2614
2018/0229390 A1 * 8/2018 Gereg ..... B26D 7/0691
2018/0333886 A1 * 11/2018 Gereg ..... B26D 7/2614

* cited by examiner

CUTTING HEADS, CUTTING MACHINES EQUIPPED THEREWITH, AND METHODS OF OPERATION

CROSS-REFERENCE TO RELATED APPLICATIONS

This application claims the benefit of U.S. Provisional Application No. 62/787,568 filed Jan. 2, 2019, the contents of which are incorporated herein by reference.

BACKGROUND OF THE INVENTION

The present invention generally relates to machines for cutting products, including but not limited to slicing, strip cutting, shredding, and/or granulating food products. The invention particularly relates to clamping and adjustment units for assembling, securing, and adjusting various components of a cutting machine in a manner that promotes sanitary operation and maintenance of the machine, as a nonlimiting example, if the product being cut is a food product.

Various types of equipment are known for slicing, strip cutting, shredding, or granulating food products, as nonlimiting examples, vegetables, fruits, dairy products, and meat products. Widely used machines for this purpose are commercially available from Urschel Laboratories, Inc., and include machines under the name Model CC®. Model CC® machines are centrifugal-type machines capable of cutting a wide variety of products at high production capacities. The Model CC® line of machines is particularly adapted to produce uniform slices, strip cuts, shreds, and granulations. Certain configurations and aspects of Model CC® machines are represented in U.S. Pat. Nos. 3,139,128, 3,139,129, 5,694,824, 6,968,765, 7,658,133, 8,161,856, 9,193,086, 9,469,041, and 10,456,943 and U.S. Patent Application Publication Nos. 2016/0361831 and 2018/0126581. The entire contents of these prior patent documents are incorporated herein by reference.

FIG. 1 schematically depicts a machine 10 representative of a Model CC® machine. The machine 10 includes a generally annular-shaped cutting head 12 equipped with cutting knives (not shown) mounted at its inner circumference. An impeller 14 is coaxially mounted within the cutting head 12 and has an axis 17 of rotation that coincides with an axis of the cutting head 12. The impeller 14 is rotationally driven about its axis 17 through a shaft that is enclosed within a housing 18 and coupled to a gear box 16. The cutting head 12 is mounted on a support ring 15 above the gear box 16 and remains stationary as the impeller 14 rotates. Products are delivered to the cutting head 12 and impeller 14 through a feed hopper 11 located above the impeller 14. In operation, the hopper 11 delivers products to the impeller 14, whose rotation generates centrifugal forces that cause the products to move outward into engagement with the knives of the cutting head 12. The impeller 14 comprises generally radially-oriented paddles 13, each having a face that engages and directs the products radially outward toward and against the knives of the cutting head 12 as the impeller 14 rotates. Other aspects pertaining to the construction and operation of Model CC® machines, including various embodiments thereof, can be appreciated from the aforementioned prior patent documents incorporated herein by reference.

FIG. 2 is an isolated view of a nonlimiting embodiment of the cutting head 12 of FIG. 1, and FIG. 3 is a fragmentary bottom view of the cutting head 12 of FIG. 2. The cutting head 12 is generally annular-shaped with cutting knives 20 mounted at its perimeter. Each knife 20 projects radially inward in a direction generally opposite the direction of rotation of the impeller 14, and defines a cutting edge at its radially innermost extremity. The cutting head 12 further comprises a lower support ring 22, an upper support ring 24, and circumferentially-spaced support segments, also referred to herein as shoes 26, to which the knives 20 of the cutting head 12 are individually secured with clamping assemblies 28. The shoes 26 are represented as secured with fasteners 30 to the support rings 22 and 24, such that the rings 22 and 24 and shoes 26 define a rigid structural unit or frame of the cutting head 12 to which the clamping assemblies 28 and other components of the cutting head 12 are assembled and secured. Each clamping assembly 28 includes a knife holder 28A mounted with fasteners 29 to the radially inward-facing side of a shoe 26, and a clamp 28B mounted on the radially outward-facing side of a shoe 26 to secure a knife 20 to the knife holder 28A.

FIGS. 2 and 3 further represent the trailing edge of each shoe 26 as defined by a removable component, referred to herein as a gate 34, that defines a replaceable interior transition surface secured with fasteners 35 to the shoe 26. As best seen in FIG. 3, a food product crosses a gate 34 prior to encountering the trailing knife 20 mounted to the succeeding shoe 26, and the trailing edge defined by each gate 34 cooperates with the cutting edge of the trailing knife 20 to define a cutting gap (or gate opening) therebetween. Each shoe 26 is equipped with coaxial pivot pins (not shown) that engage holes in the support rings 22 and 24. By pivoting on its pins, the orientation of a shoe 26 can be adjusted to alter the radial location of the cutting edge of its knife 20 with respect to the axis of the cutting head 12 and with respect to the trailing edge defined by the gate 34 of the preceding shoe 26, thereby controlling the gate opening between the cutting and trailing edges that determines the thickness of the cut food product. As an example, adjustment can be achieved with an adjusting screw and/or pin 32 located circumferentially behind the pivot pins.

FIGS. 2 and 3 show the knives 20 and clamps 28B secured to their respective knife holders 28A with fasteners 36. Alignment of the knife 20 and clamp 28B of each assembly 28 is achieved with pins 38 that protrude from the support surface of the knife holder 26B. As better understood through the detail view of FIG. 4, the opposing surfaces of the knife holder 28A and clamp 28B result in the clamp 28B applying a force to the knife 20 adjacent its cutting edge.

While Model CC® machines have performed extremely well for use in a wide variety of cutting applications, further improvements are continuously desired and sought for cutting machines.

BRIEF DESCRIPTION OF THE INVENTION

The present invention provides cutting heads and machines equipped therewith for cutting products, including but not limited to slicing, strip cutting, shredding, and/or granulating food products.

According to one aspect of the invention, an annular-shaped cutting head is provided that includes annular-shaped first and second structural members spaced apart in an axial direction of the cutting head, and circumferentially-spaced support segments between the first and second structural members. Each support segment has a leading edge and an oppositely-disposed trailing edge, an inner surface region facing in a radially inward direction of the cutting head, an outer surface region facing in a radially outward direction of the cutting head, a knife support surface defined on the inner surface region adjacent the leading edge of the support segment, and a gate located adjacent the trailing edge of the support segment. The cutting head further has knife assemblies located adjacent the leading edge of each support segment. Each knife assembly comprises a holder opposing one of the knife support surfaces of the support segments and adapted to clamp a knife between the holder and knife support surface. The cutting head further comprises at least one of the following: first camming units engaging the first and second structural members and adapted to draw the first and second structural members together to releasably secure the support segments therebetween; second camming units located at the outer surface regions of the support segments and adapted to draw the holders of the knife assemblies toward a corresponding one of the knife support surfaces to clamp a knife between the holder and knife support surface; and/or adjustment pins engaging the first and second structural members and having a camming portion adapted to cam against the outer surface regions of the support segments adjacent the trailing edges of the support segments to deflect the gates of the support segments in the radially inward direction of the cutting head.

According to another preferred aspect of the invention, a cutting machine is provided in which an annular-shaped cutting head as described above is installed. The cutting machine includes an impeller coaxially mounted within the cutting head for rotation about an axis of the cutting head in a rotational direction relative to the cutting head.

Other aspects of the invention include methods of assembling and disassembling a cutting head as described above by operating the first and/or second camming units, and methods of adjusting a cutting head as described above by rotating the adjustment pins to deflect the gates of the support segments.

Technical aspects of machines described above preferably include the ability to utilize clamping and/or adjustment units that can reduce the number of threaded fasteners, seals, etc., that might otherwise be used or required to assemble and secure components of a cutting machine. In so doing, the number of locations in which food particles and residues might accumulate is reduced, resulting in a design that is capable of promoting sanitary operation and maintenance of the machine by making components of the machine more readily accessible for cleaning.

Other aspects and advantages of this invention will be appreciated from the following detailed description.

BRIEF DESCRIPTION OF THE DRAWINGS

FIGS. 23 through 40 are various views of components and portions of a cutting head in accordance with a second nonlimiting embodiment of the invention, wherein FIGS. 23 through 40 show views of the second embodiment corresponding to FIGS. 5 through 22, respectively, of the first embodiment.

DETAILED DESCRIPTION OF THE INVENTION

Figure 1:
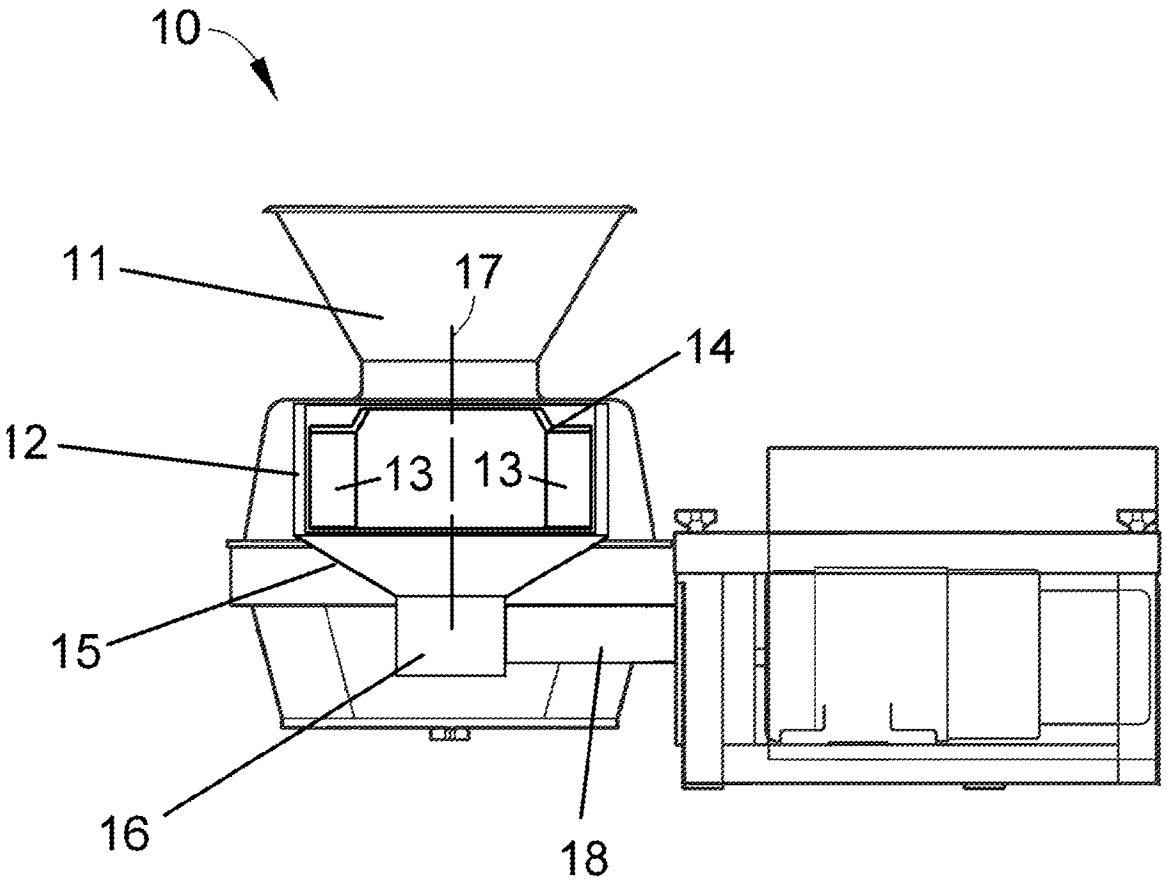
FIG. 1 PRIOR ART
FIG. 1 schematically represents a side view in partial cross-section of a centrifugal-type cutting machine known in the art.
Figure 3:
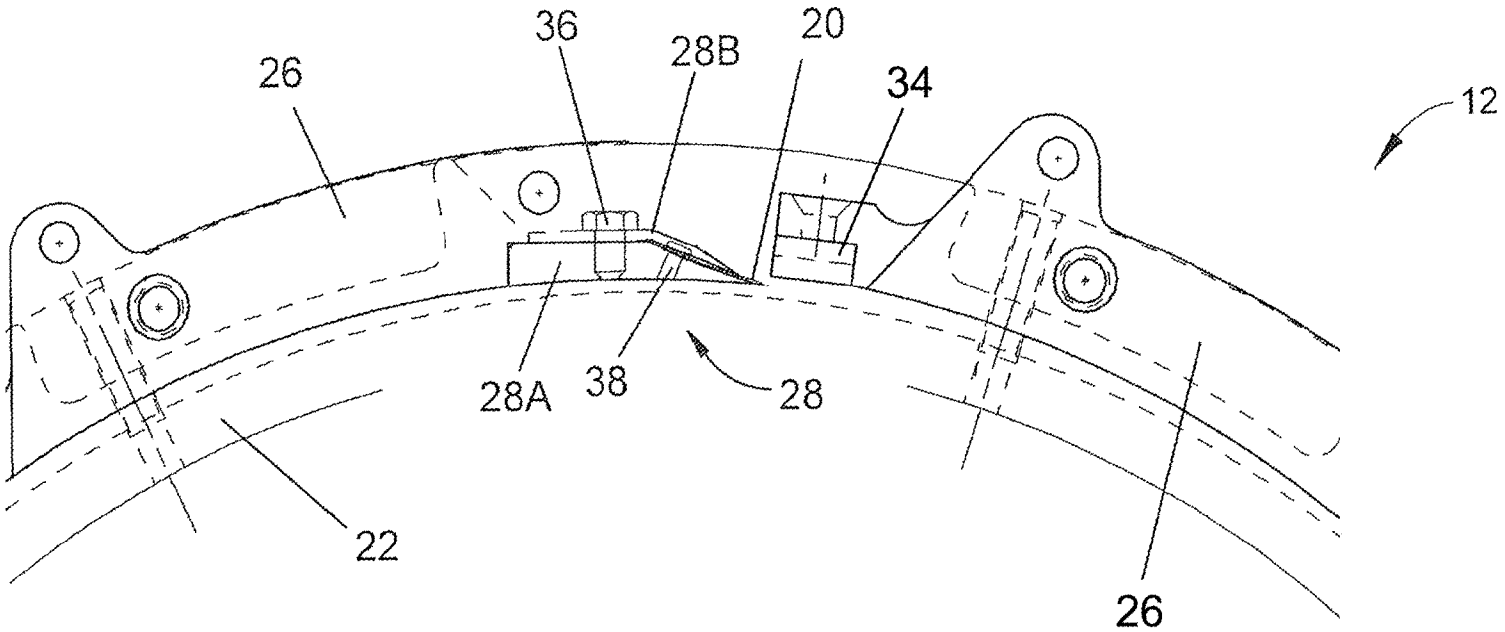
FIG. 3 PRIOR ART
FIG. 3 is a bottom view showing a fragment of the cutting head of FIG. 2.
Figure 4:
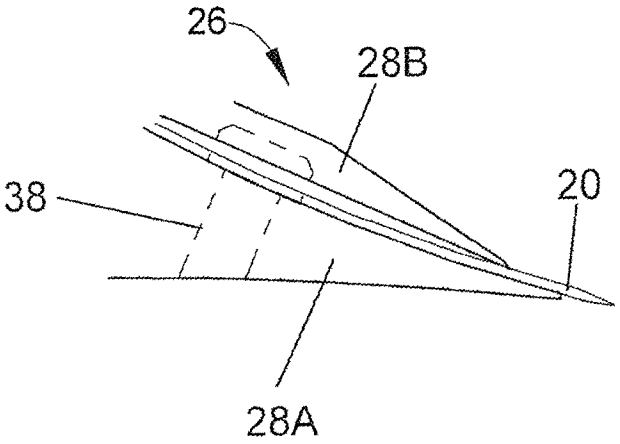
FIG. 4 PRIOR ART
FIG. 4 is a detailed view of a portion of a clamping assembly of the cutting head.
Figure 5:
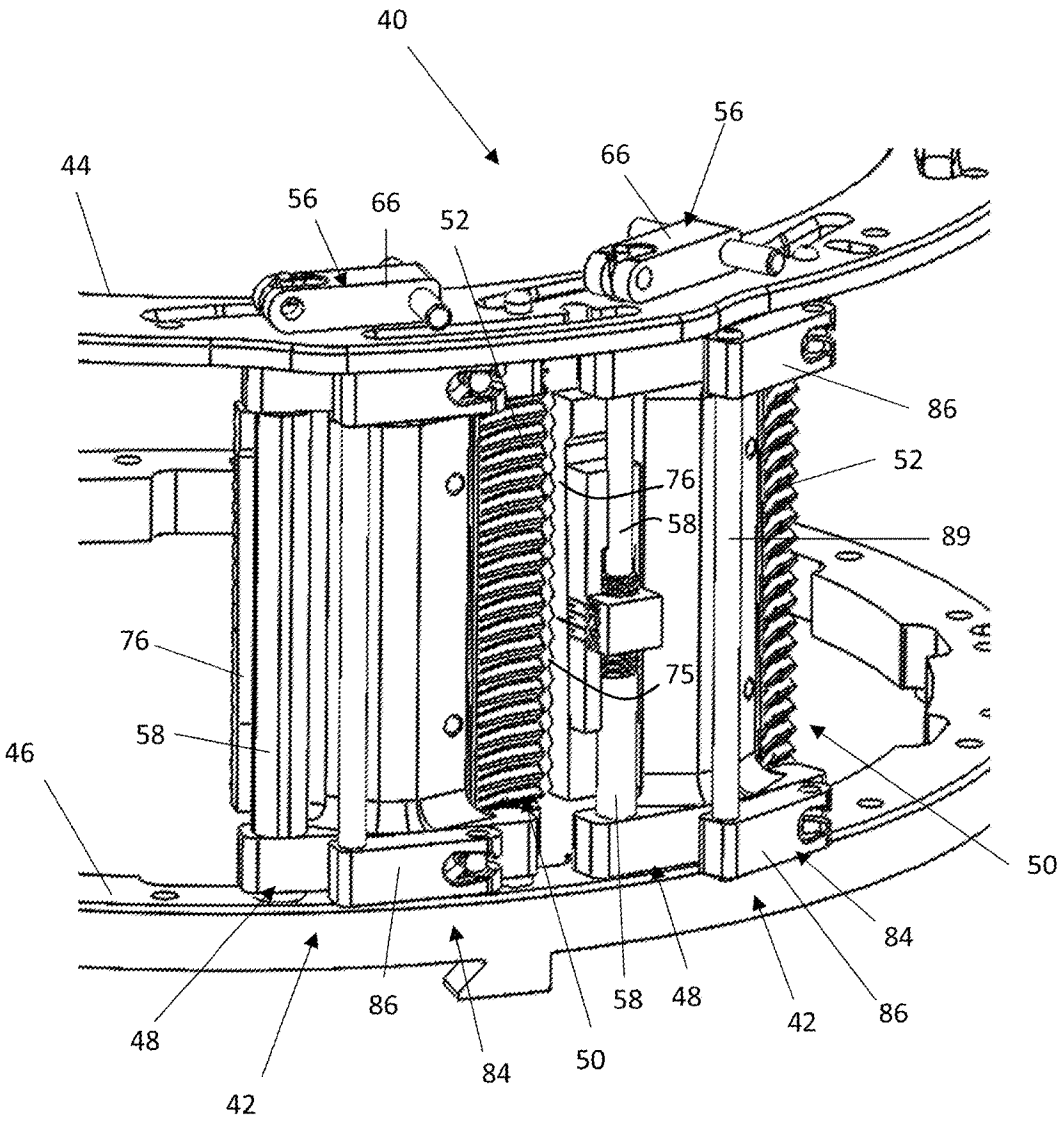
FIG. 5 is a perspective view showing a fragment of a cutting head suitable for use with the cutting machine of FIG. 1 in accordance with a first nonlimiting embodiment of the invention.
Figure 23:
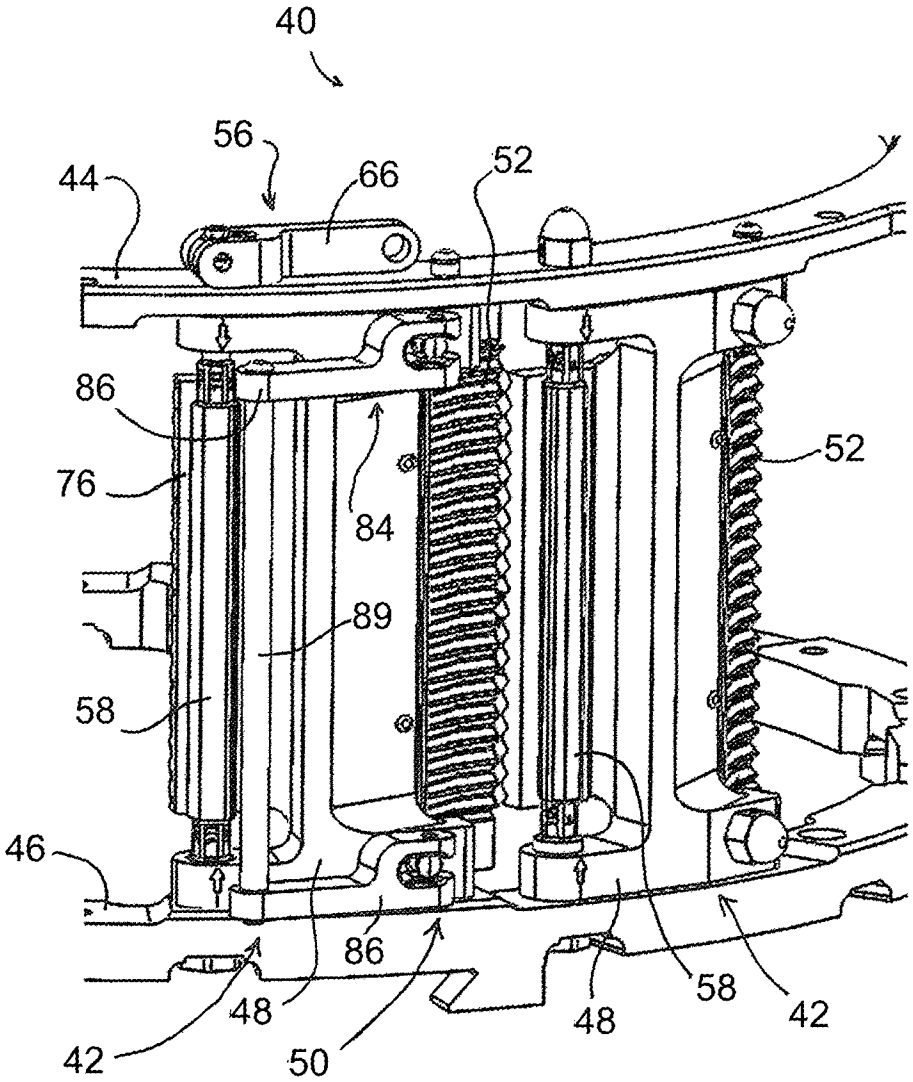
Figure 25:
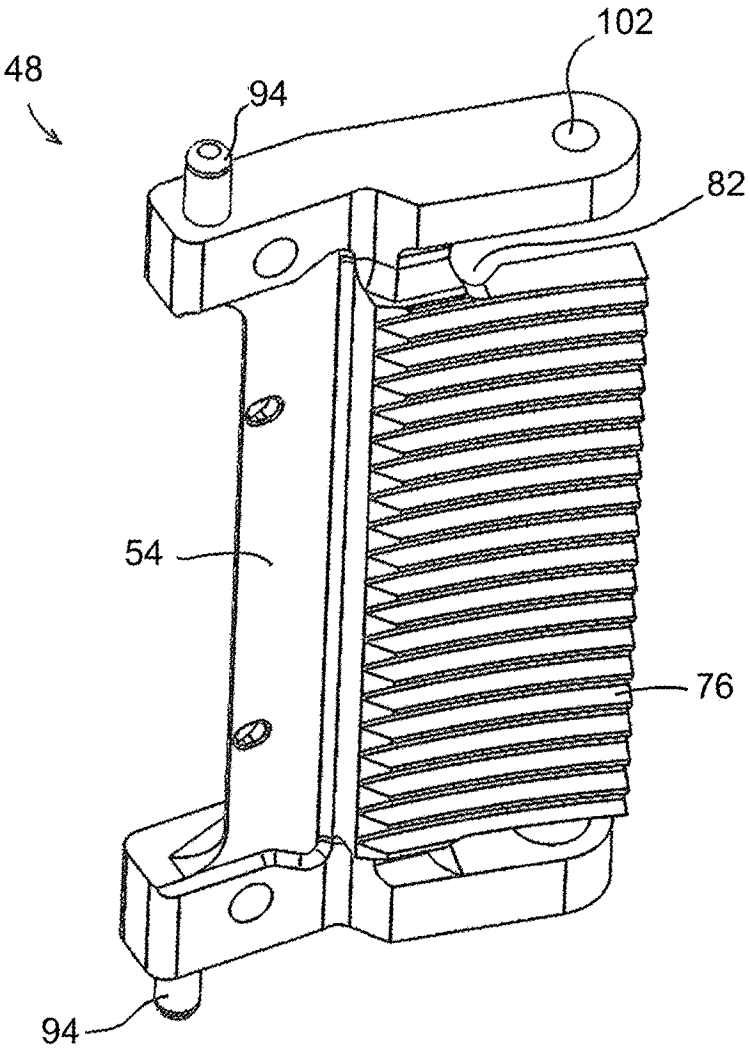
Figure 24:
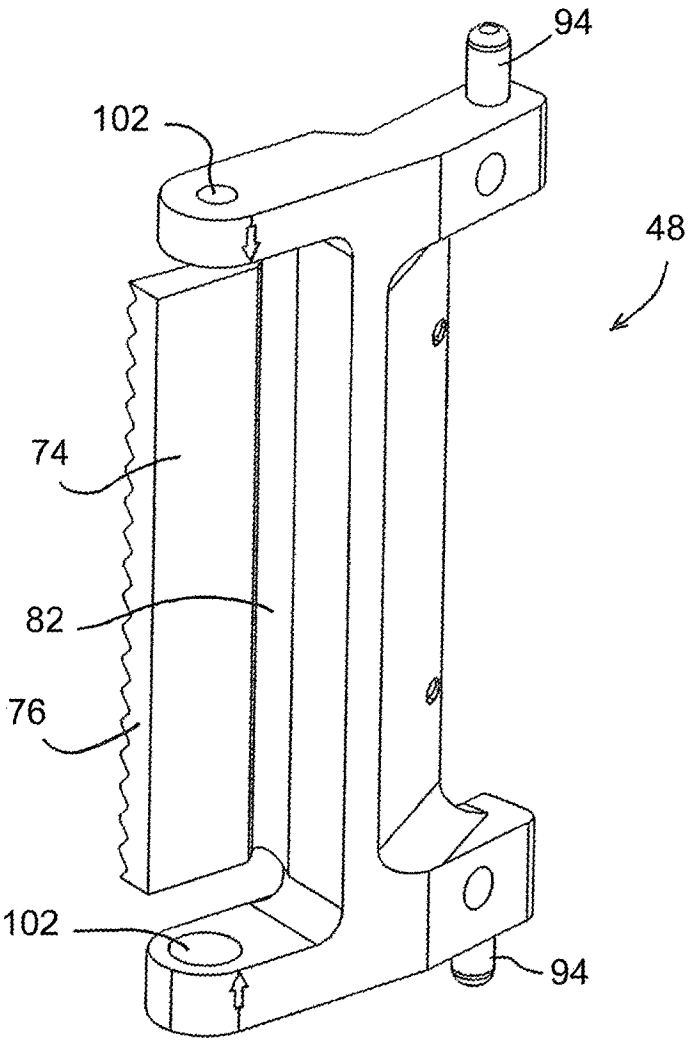
Figure 26:
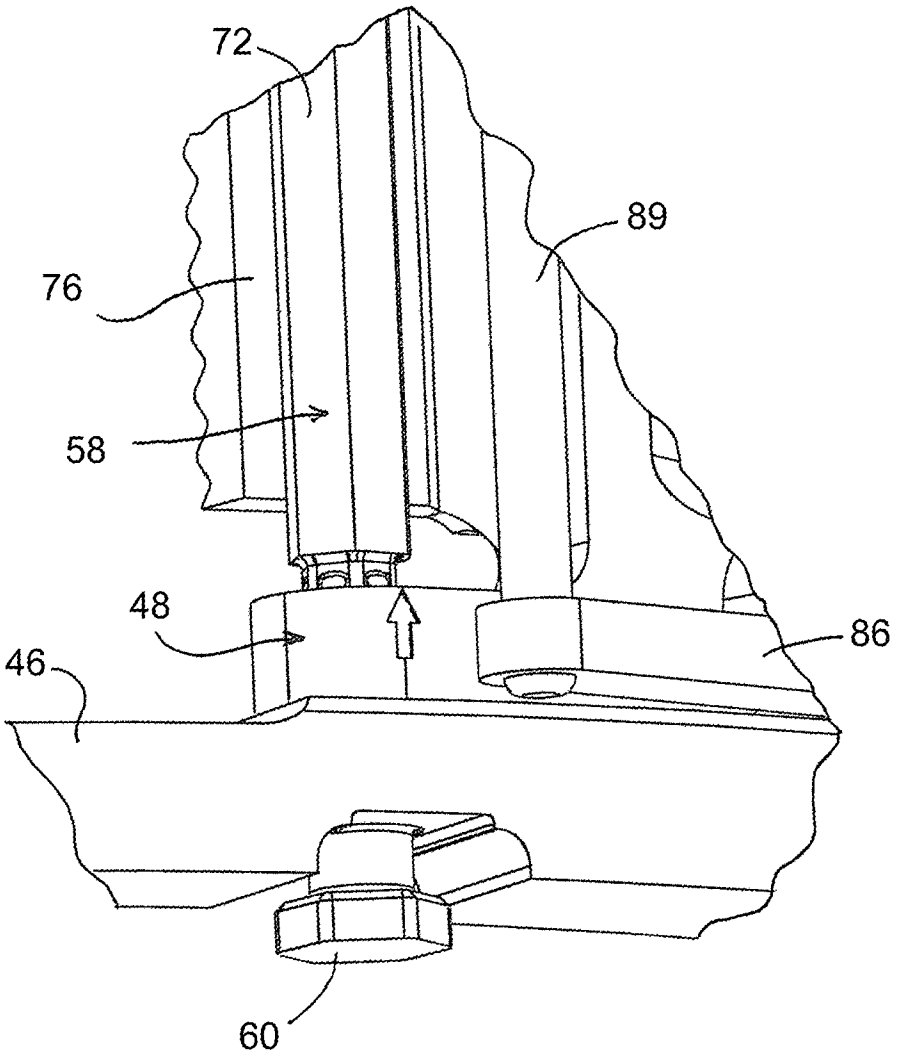
Figure 27:
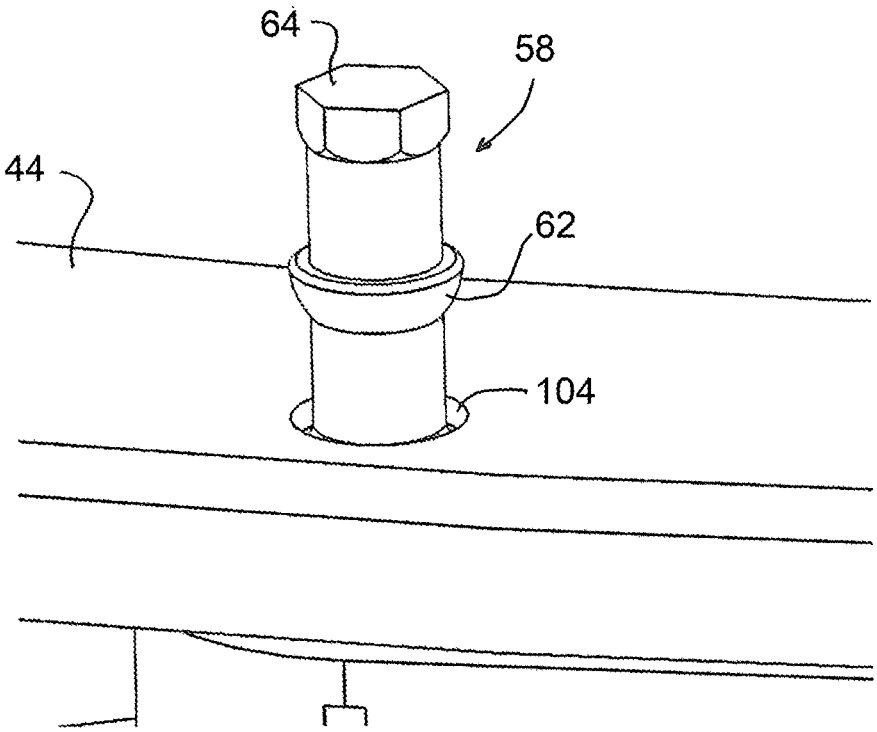
Figure 28:
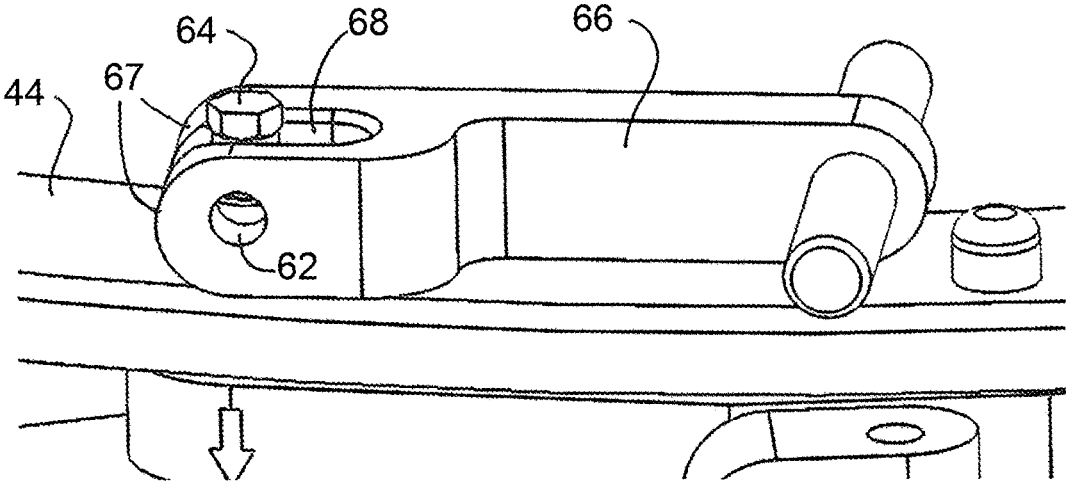
Figure 30:
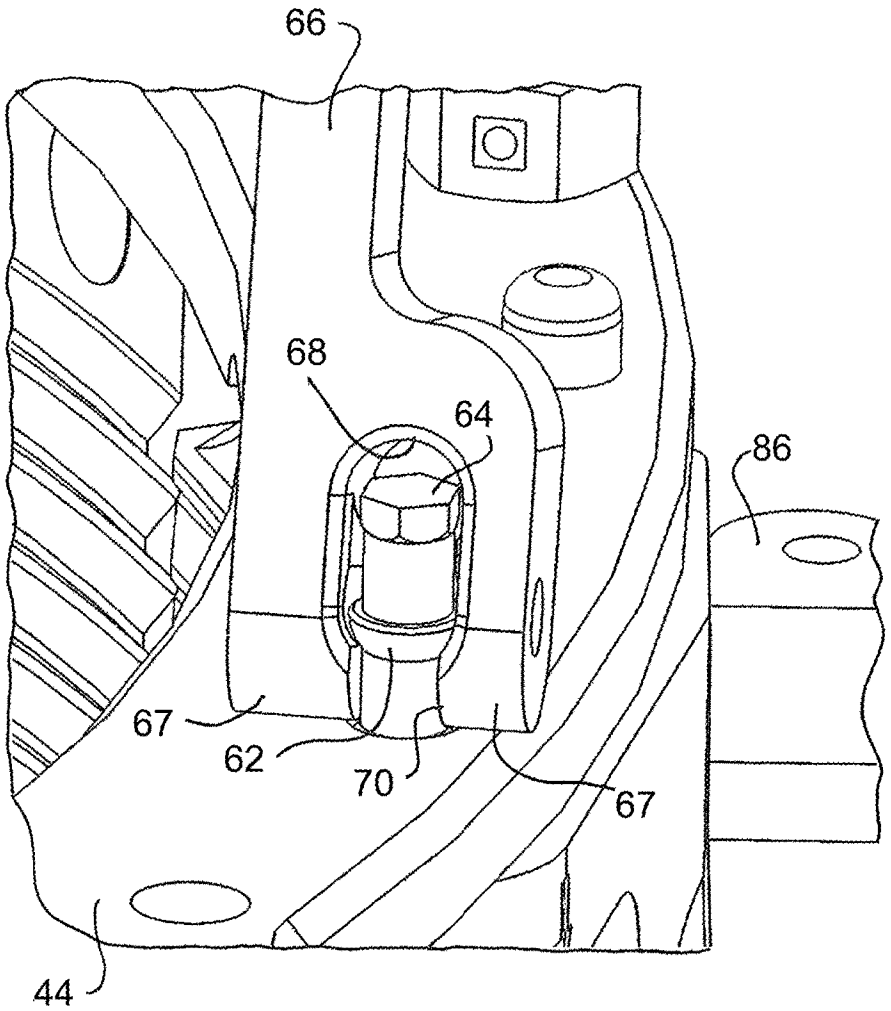
Figure 29:
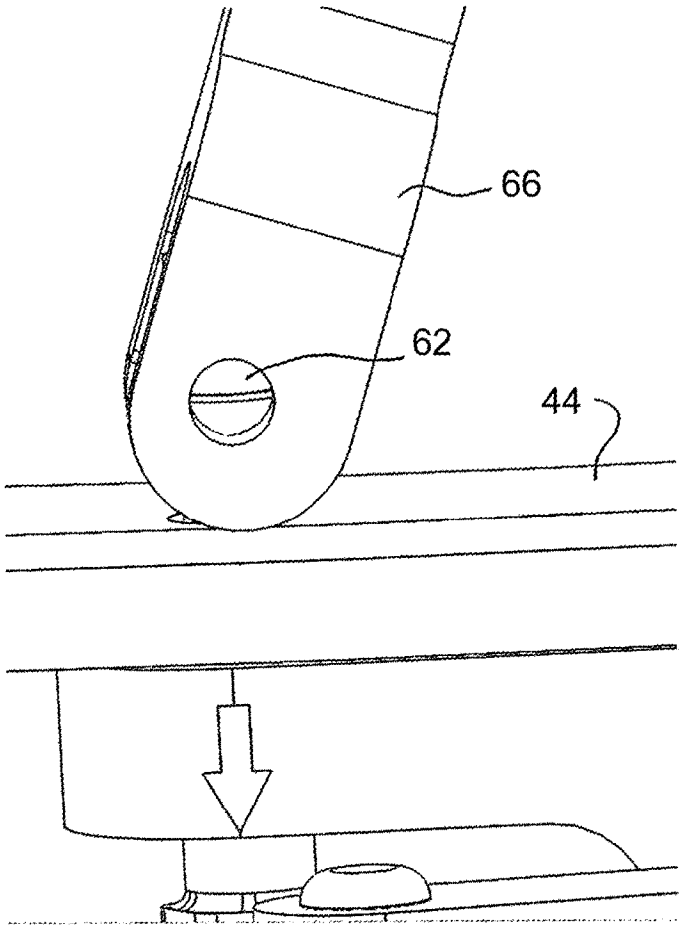
Figure 31:
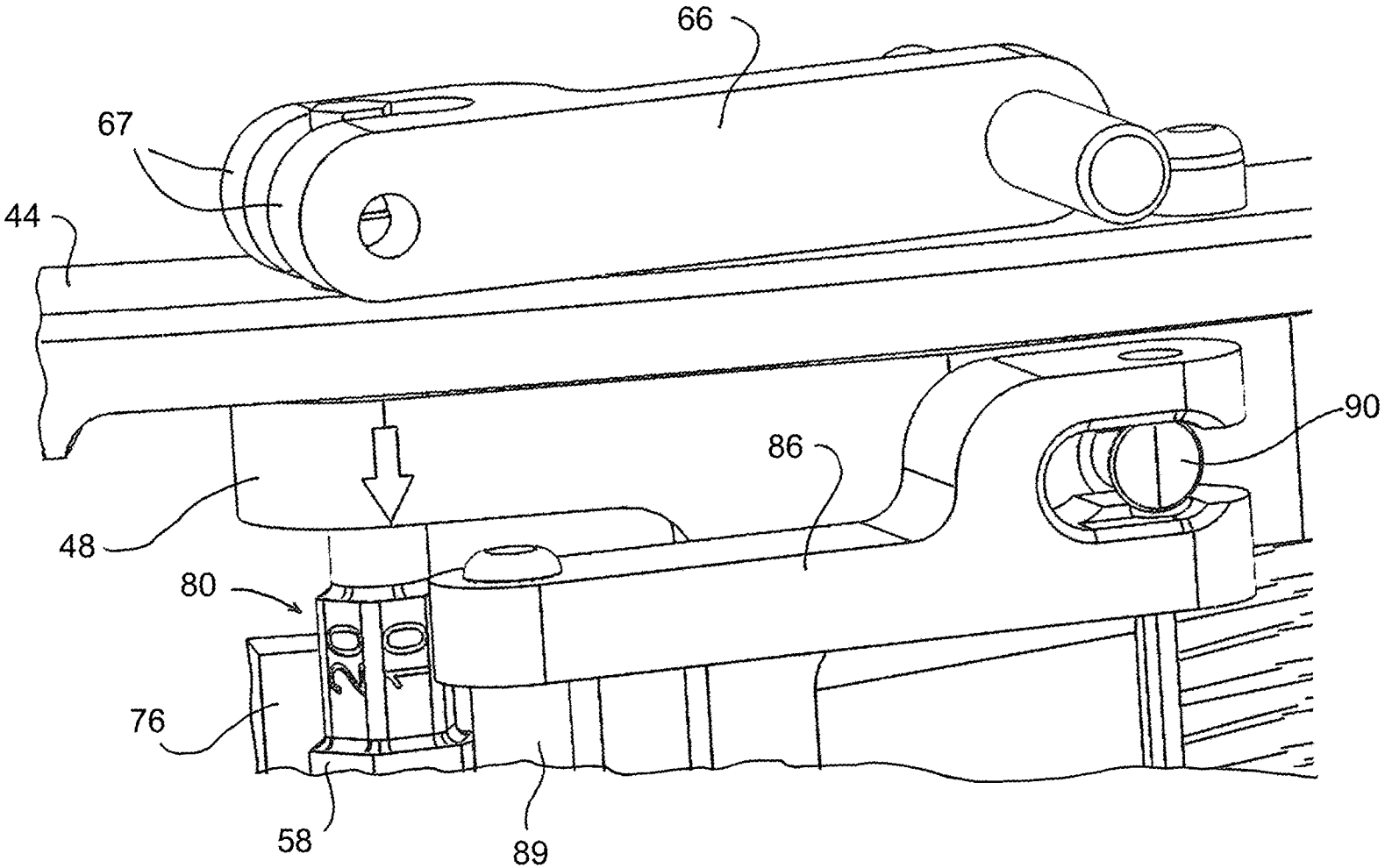
Figure 32:
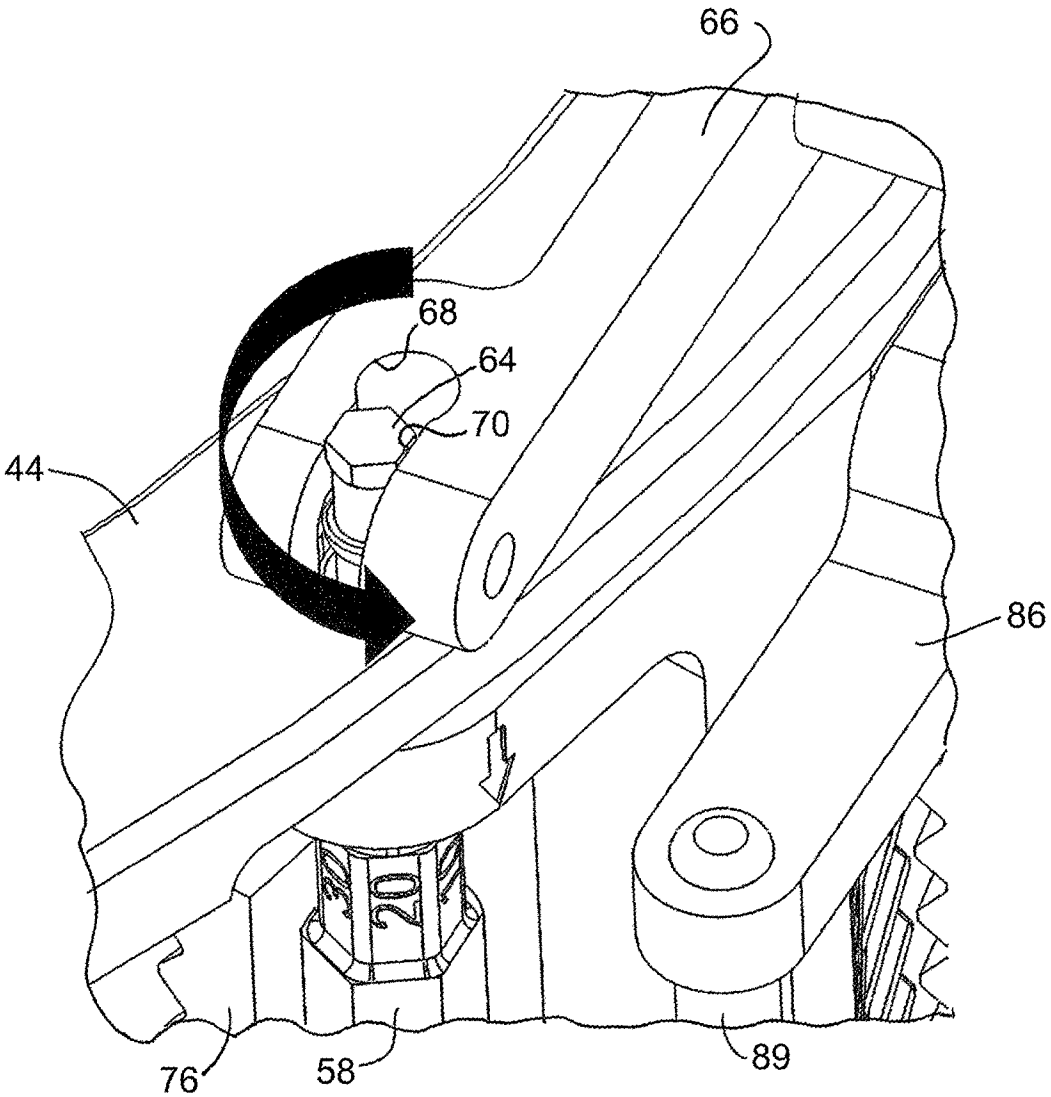
Figure 33:
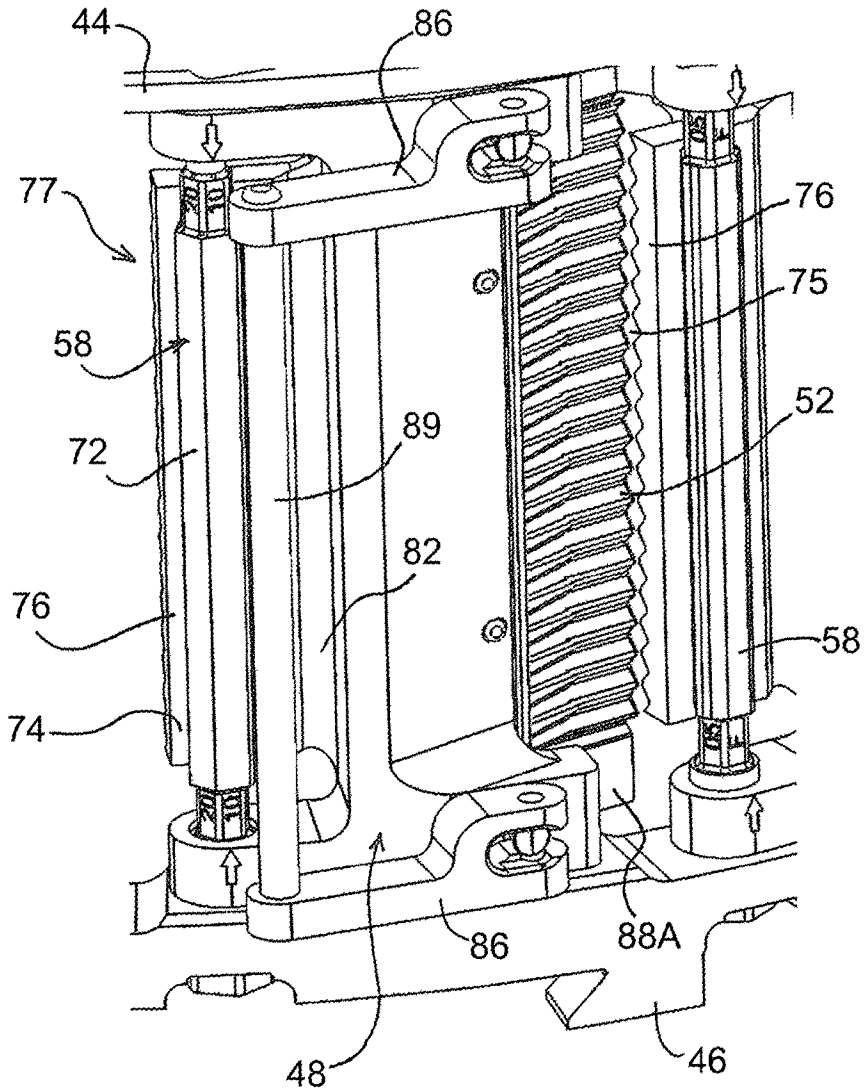
Figure 34:
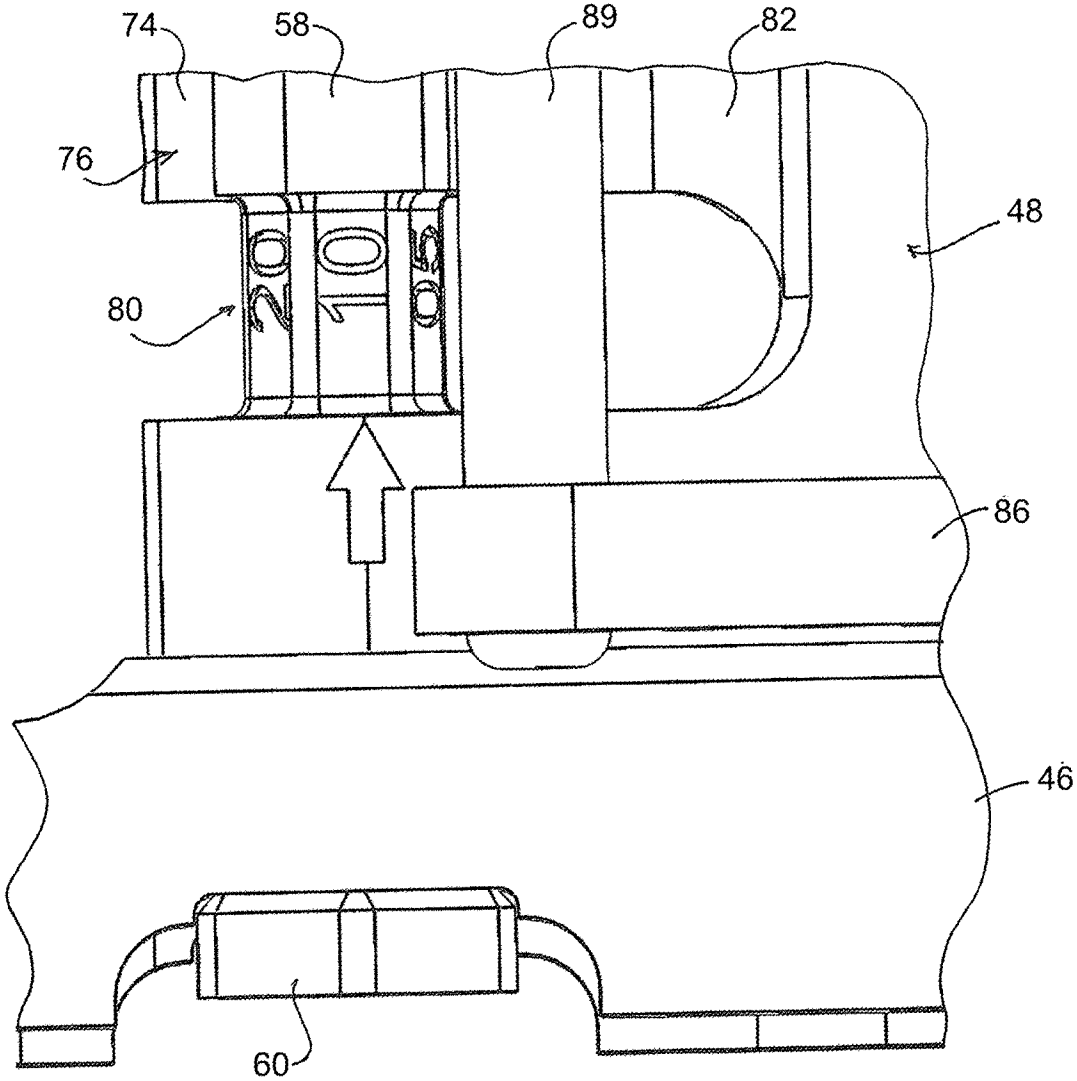
Figure 35:
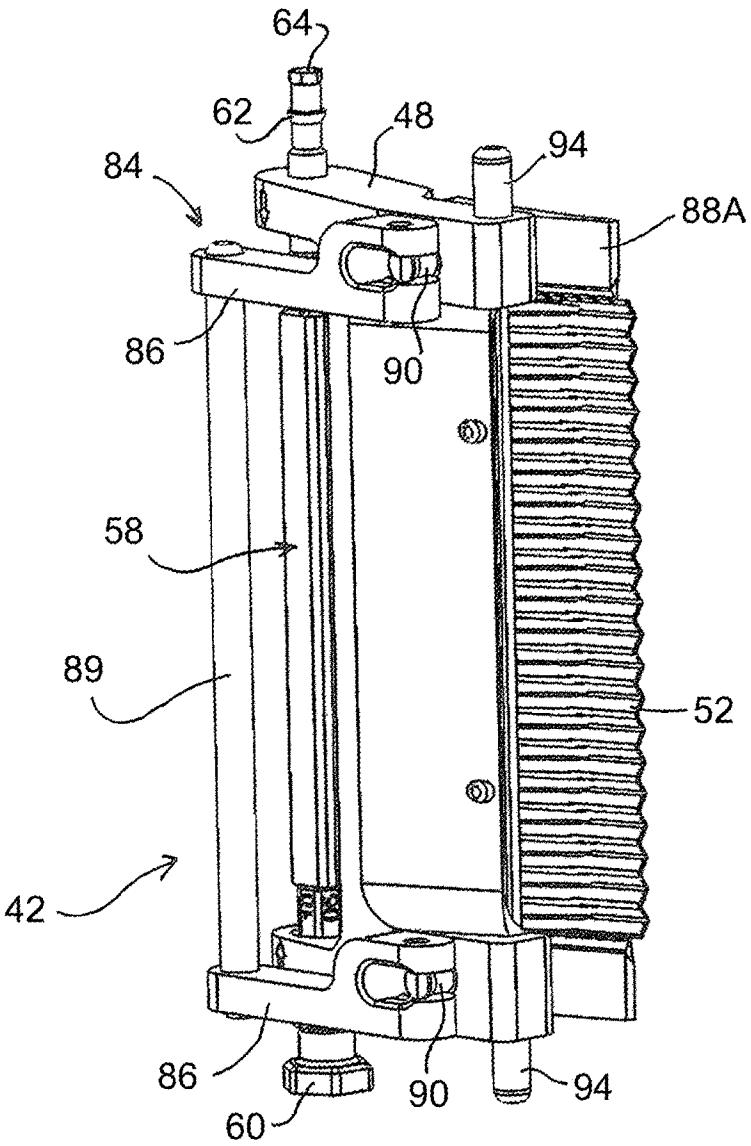
Figure 36:
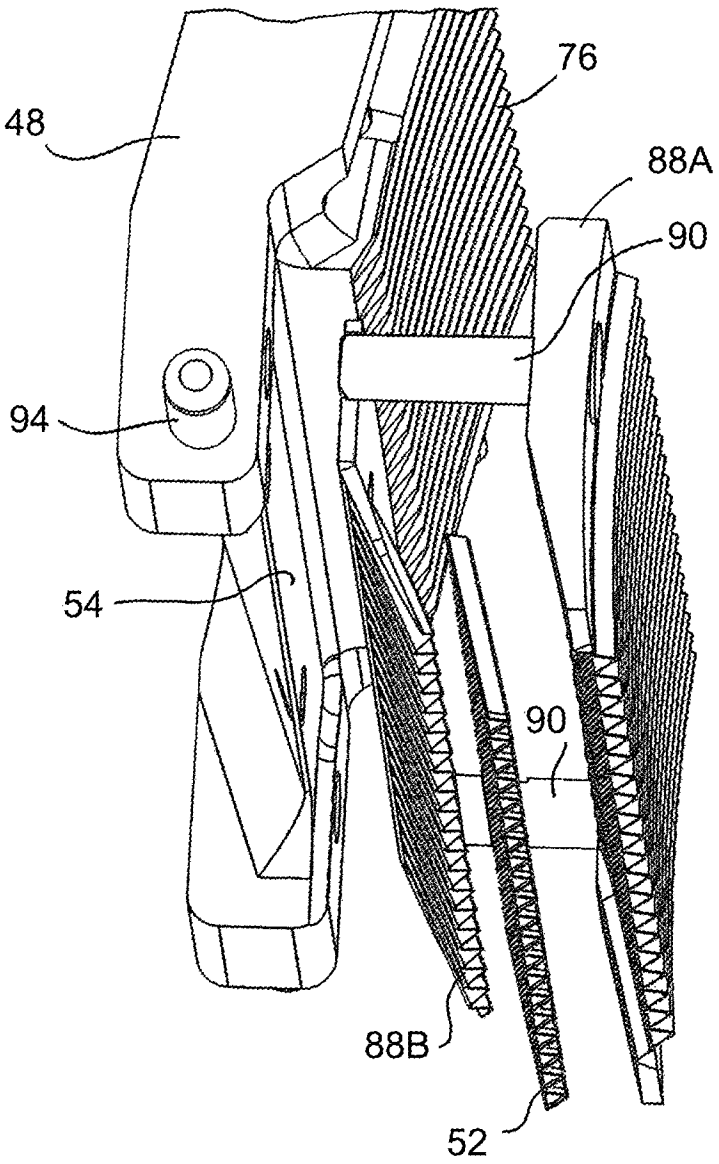
Figure 37:
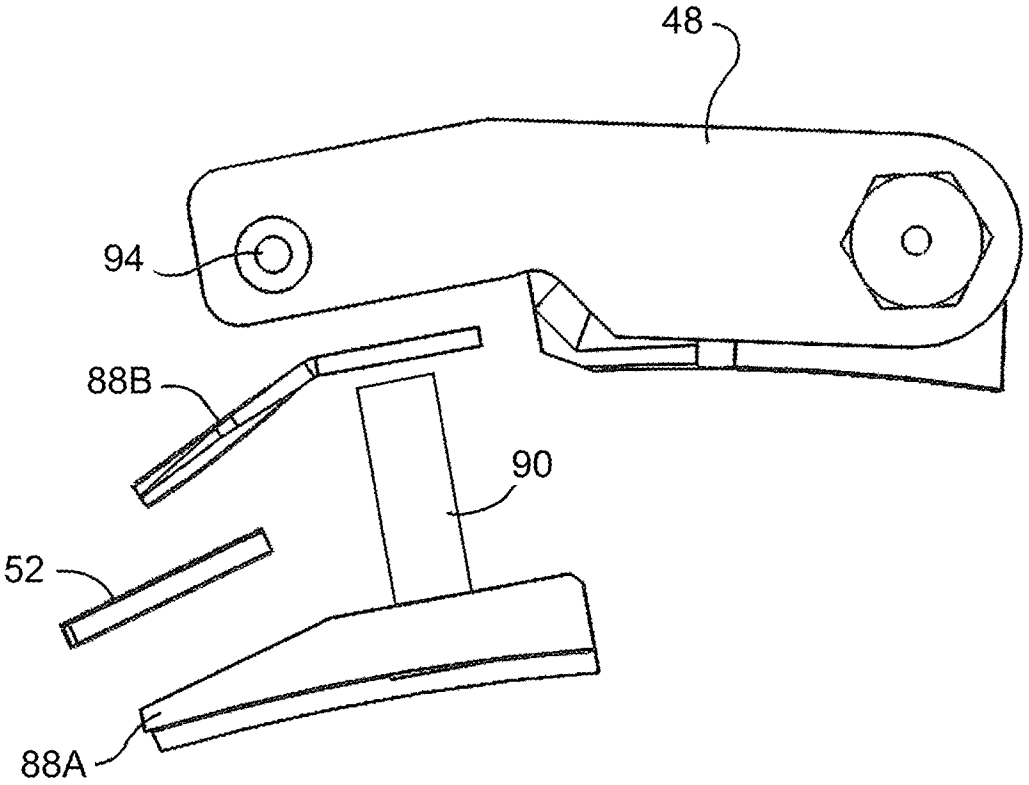
Figure 38:
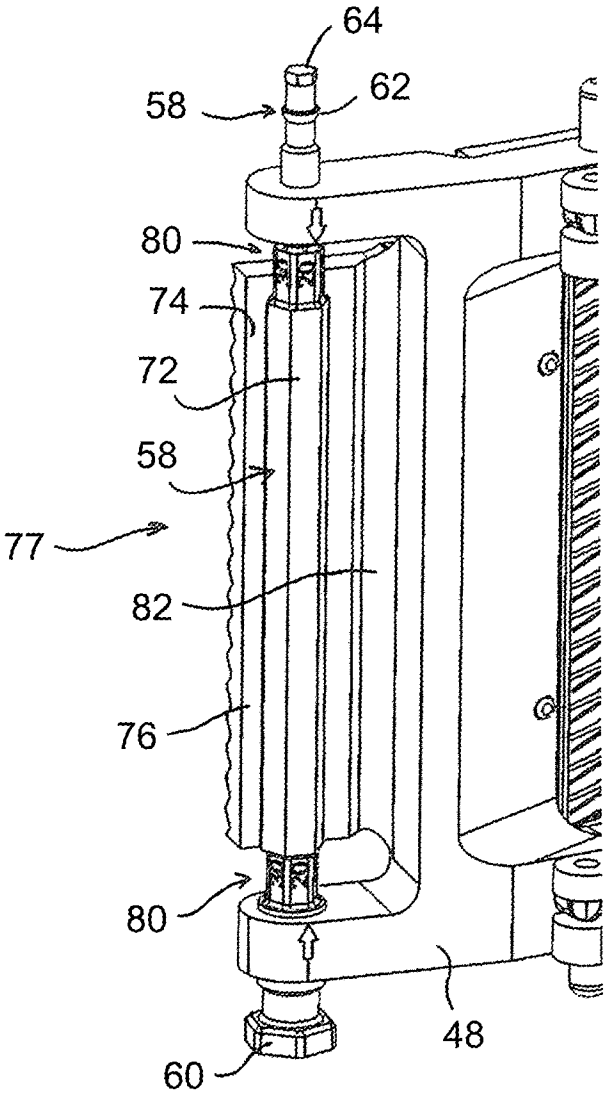
Figure 39:
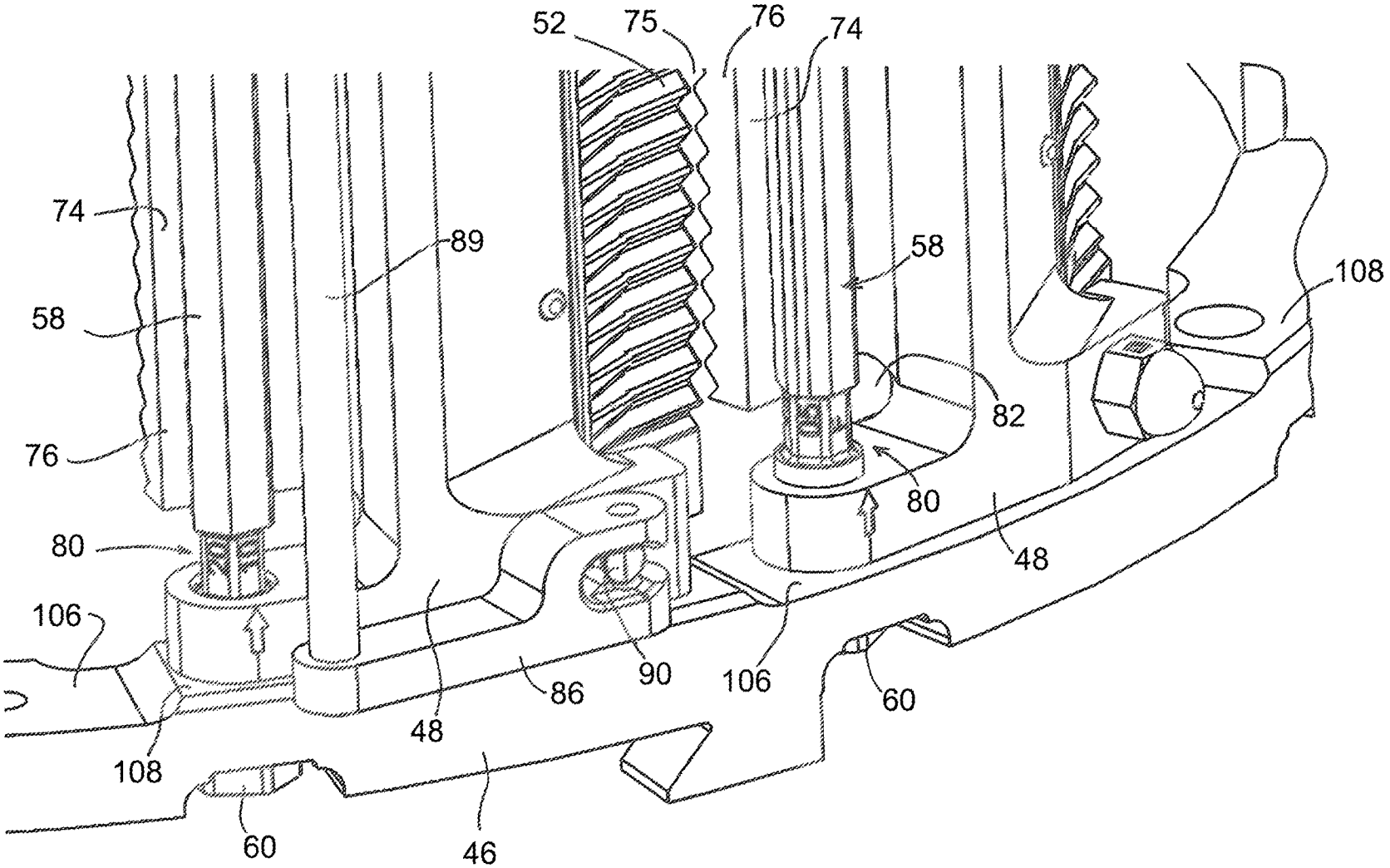

FIGS. 5 and 23 represent fragmentary portions of, respectively, first and second embodiments of cutting heads 40 that are capable of use with a variety of cutting machines, including the centrifugal cutting machine 10 depicted in FIG. 1, and in some instances may be a modification or retrofit for such a machine. FIGS. 6 through 22 and FIGS. 24 through 40 contain various views of nonlimiting aspects of the cutting heads 40 of FIGS. 5 and 23, respectively, in which clamping and/or adjustment units are employed to reduce the number of threaded fasteners, seals, etc., often used or required to assemble and secure components of a cutting head, such as the cutting head 12 of FIGS. 2 through 4. The cutting heads 40 will be described hereinafter in reference to the cutting machine 10 of FIG. 1 equipped with an impeller 14 as described in reference to FIG. 1, and as such the following discussion will focus primarily on certain aspects of the invention, whereas other aspects not discussed in any detail may be, in terms of structure, function, materials, etc., essentially as was described in reference to FIGS. 1 through 4. However, it will be appreciated that the teachings of the invention are more generally applicable to various types of centrifugal cutting machines.

To facilitate the description provided below of the embodiments represented in the drawings, relative terms, including but not limited to, "vertical," "horizontal," "lateral," "front," "rear," "side," "forward," "rearward," "upper," "lower," "above," "below," "right," "left," etc., may be used in reference to the orientation of the cutting heads 40 as they would be mounted in the machine 10 of FIG. 1. On the basis of a coaxial arrangement of each cutting head 40 with the impeller 14 of the machine 10, relative terms including but not limited to "axial," "circumferential," "radial," etc., and related forms thereof may also be used below to describe the nonlimiting embodiments represented in the drawings. Furthermore, as used herein, "trailing" (and related forms thereof) refers to a position on a cutting head that follows or succeeds another in the direction of rotation of an impeller assembled with the cutting head, whereas "leading" (and related forms thereof) refers to a position on a cutting head that is ahead of or precedes another in the direction opposite the impeller's rotation. All such relative terms are intended to indicate the construction and relative orientations of components and features of the cutting heads 40, and therefore are relative terms that are useful to describe the illustrated embodiments but should not be otherwise interpreted as limiting the scope of the invention.

Figure 2:
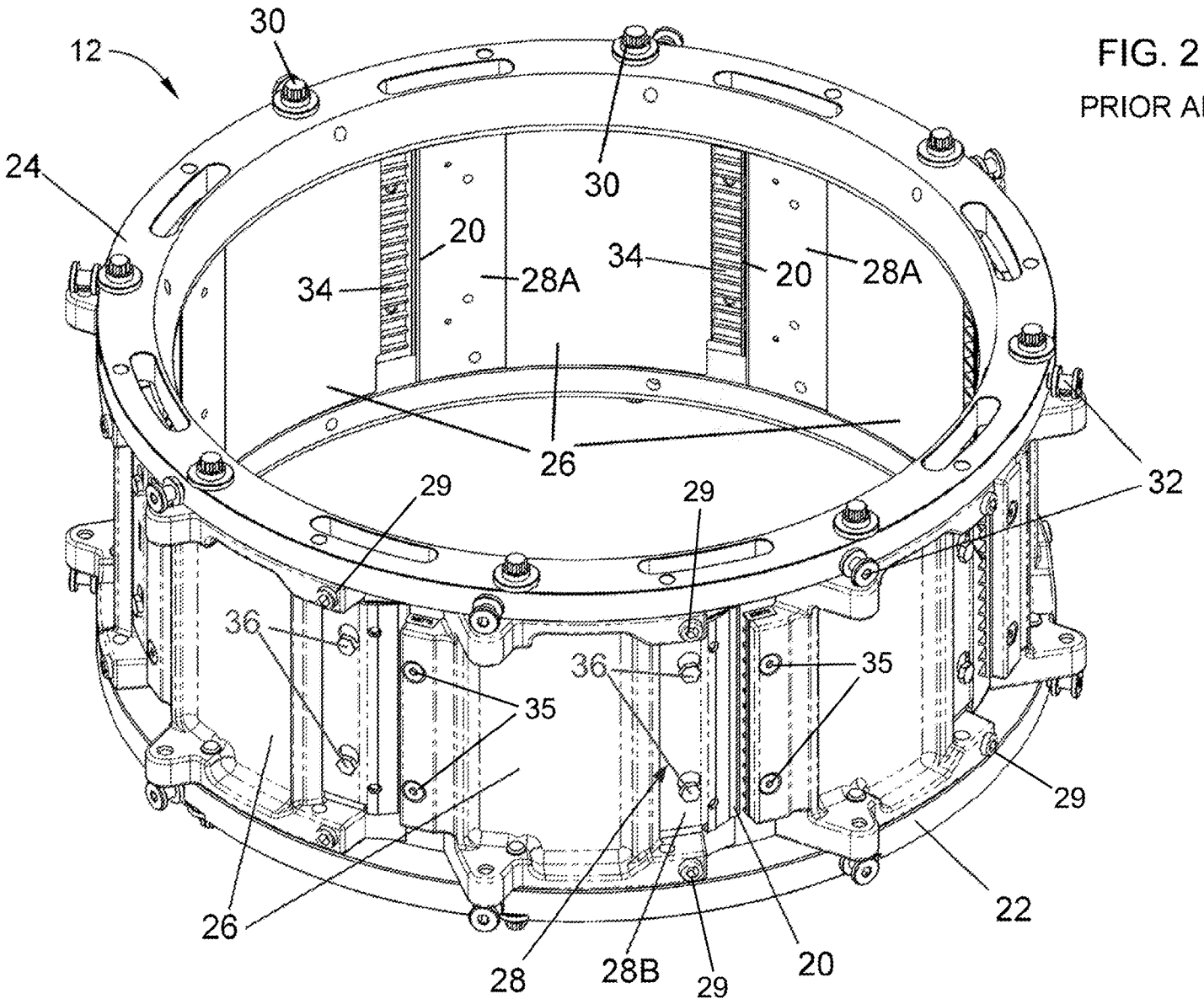
FIG. 2 PRIOR ART
FIG. 2 is a perspective view representing a cutting head of a type suitable for use with the cutting machine of FIG. 1.

With reference to the embodiment of FIGS. 5 through 22, the cutting head 40 of FIG. 5 has a generally annular-shape, similar to the cutting head 12 of FIG. 2. In the fragmentary view of FIG. 5, the cutting head 40 is depicted as having two cutting units 42, though as evident from FIG. 2 the cutting head 40 would typically have additional cutting units 42 circumferentially mounted along its entire perimeter. The cutting units 42 are mounted between first and second annular-shaped structural members, referred to herein as upper and lower support rings 44 and 46 based on their represented shapes and typical positions within the machine 10 of FIG. 1. The rings 44 and 46 are axially spaced apart from each other in an axial direction of the cutting head 40. Each cutting unit 42 comprises a support segment, referred to herein as a shoe 48, mounted to and between the rings 44 and 46, and a knife assembly 50 mounted at a leading edge of the shoe 48 and securing an individual knife 52 to the cutting unit 42. Each knife 52 is mounted to and supported by a radially inner surface of the shoe 48, referred to herein as a knife support surface 54 that is visible in FIG. 7. The knives 52 are mounted to project in a radially inward direction of the cutting head 40 and in a direction that is generally opposite the direction of rotation of an impeller within the cutting head 40.

Each knife 52 defines a cutting edge at its radially innermost extremity that engages products propelled within the cutting head 52 by an impeller rotating within the cutting head 40. Depending on the configuration of the knives 52, slices, strip cuts, shreds and granulations may be produced with the cutting head 40 as a result of products engaging the knives 52. In the particular but nonlimiting embodiment represented in FIG. 5, the knives 52 are represented as corrugated and adjacent knives 52 are offset 180 degrees from each other in the axial direction of the cutting head 40, so that peaks of a knife 52 are aligned with valleys of a knife 52 of an adjacent cutting unit 42, such that the resulting products produced by the cutting head 40 are shreds. Further details relating to the manner in which the knives 52 are secured within their respective knife assemblies 50 will be discussed below in reference to FIGS. 15 and 17 through 19.

Figure 8:
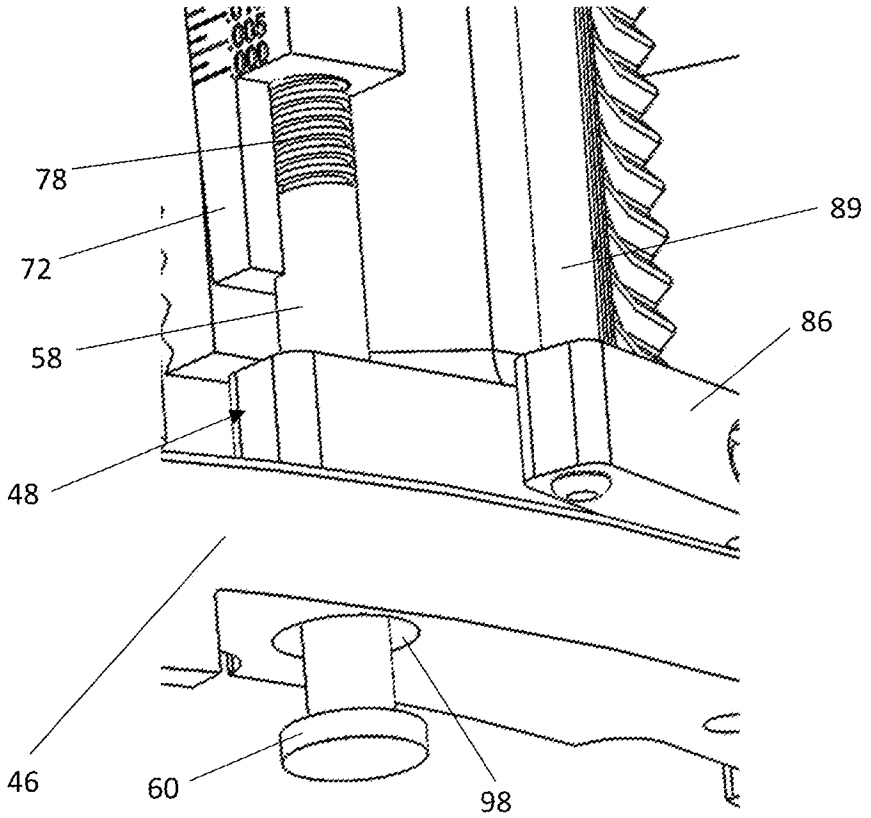
FIG. 8 is a fragmentary perspective view of a lower end of a pin of a first camming unit adapted to releasably secure support segments of the cutting head of FIG. 5 between first and second structural members of the cutting head, and shows the lower end of the pin protruding through and below one of the structural members.
Figure 10:
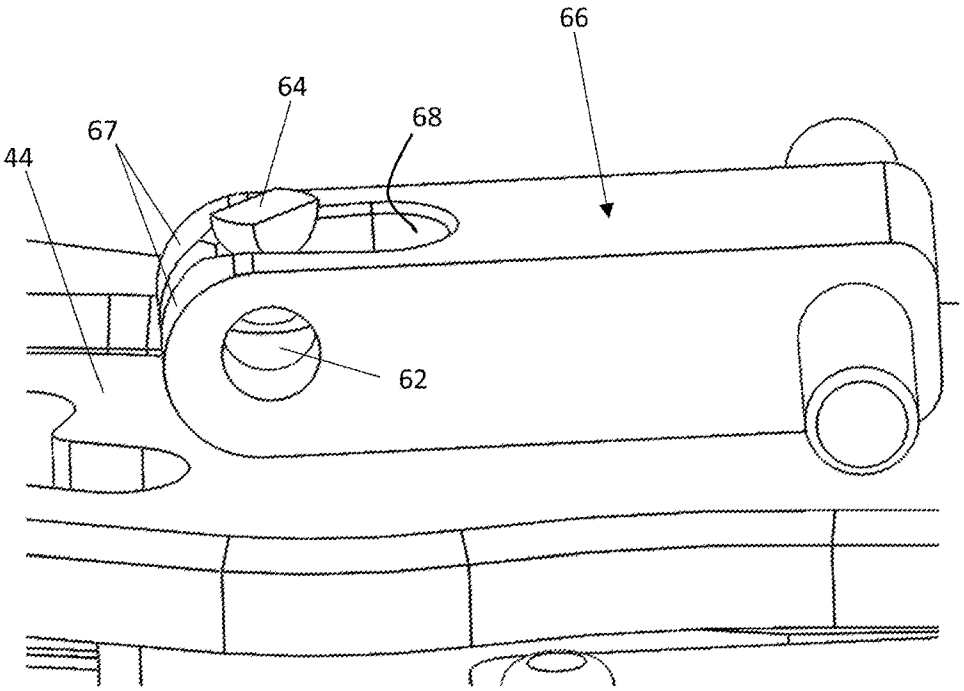
FIGS. 9 through 14 contain various fragmentary perspective views showing components and the operation of a camming member of the first camming unit located opposite the lower end of the pin depicted in FIG. 8.
Figure 9:
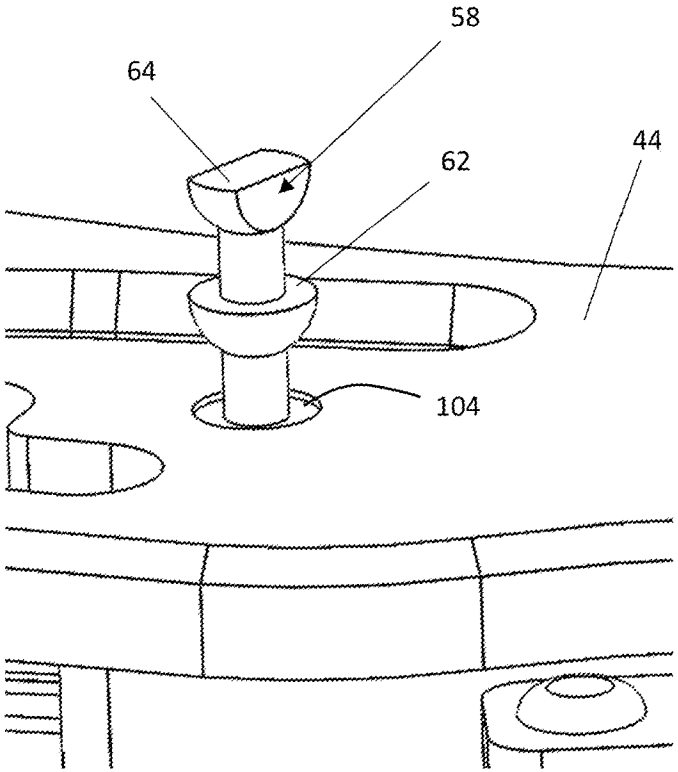
Figure 12:
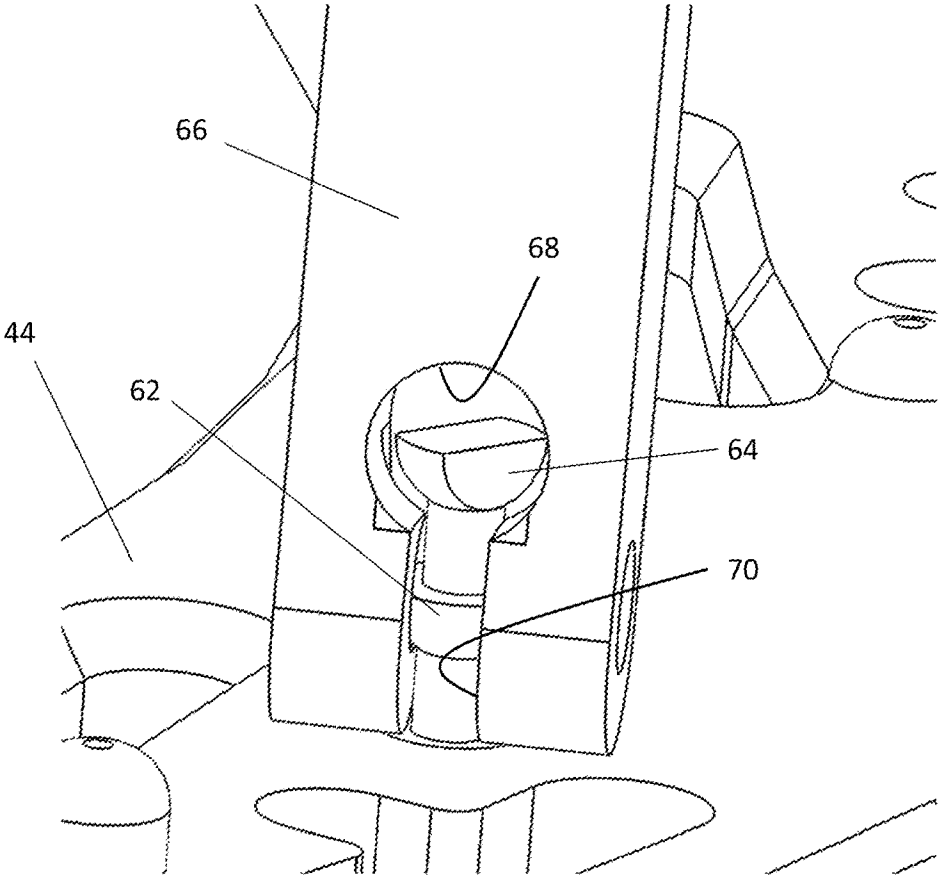
Figure 11:
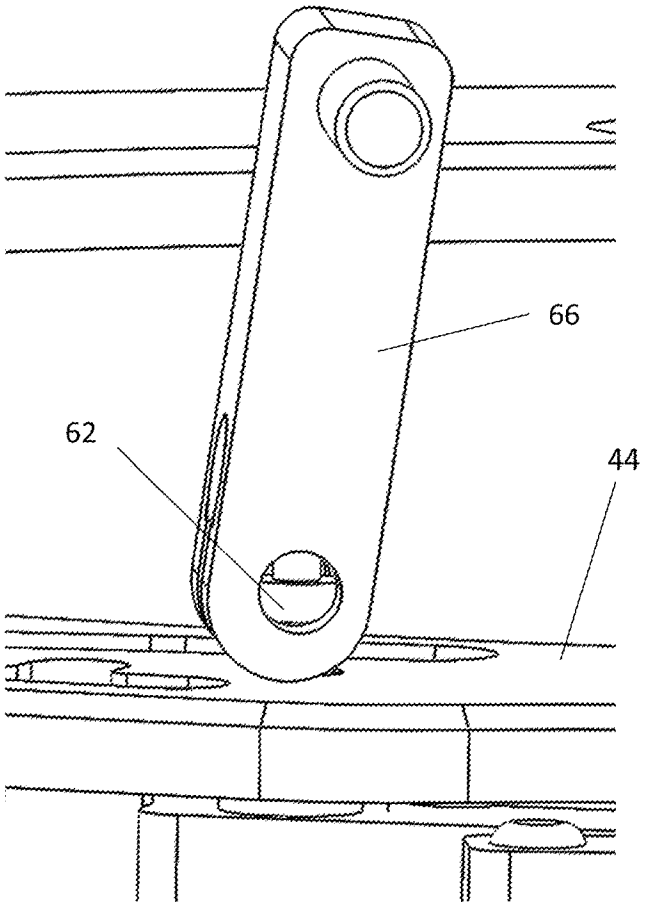

FIG. 5 represents the shoes 48 as mounted to and secured between the rings 44 and 46 with camming units 56. Each camming unit 56 comprises a pin 58 that spans the axial distance between the rings 44 and 46. As depicted in FIG. 8, a lower end of each pin 58 protrudes through a hole 98 in the lower ring 44, and has an enlarged head 60 that prevents the pin 58 from being withdrawn upward through the hole 98. FIG. 9 depicts an oppositely-disposed upper end of the pin 58 as protruding through a hole 104 in the upper ring 44. The upper end of the pin 58 has an enlarged feature 62 (represented as a fragment of a sphere) adjacent the upper end of the pin 58 and an enlarged feature 64 (represented as roughly one-half of a disk) disposed at the upper end of the pin 58. The feature 62 is configured to pivotally engage a slot 68 in a camming member 66, depicted in FIGS. 10 through 14 as assembled with the upper end of the pin 58. The camming member 66 is located at the upper ring 44, and utilizes an over-center or toggle operation in which a camming surface 67 of the camming member 66 bears against a surface of the upper ring 44 to achieve a bistable pivoting action for the member 66, which displaces the upper end of the pin 58 away from the upper ring 44 to draw the rings 44 and 46 toward each other and thereby releasably secure the shoes 48 therebetween. More particularly, FIG. 10 represents the position of the camming member 66 in a locking position in which the feature 62 of the pin 58 is captured within the slot 68 of the camming member 66 and the pin 58 is tensioned through the action of the camming surface 67 of the camming member 66, such that the rings 44 and 46 and the shoe 48 associated with the camming member 66 are drawn together by its pin 58 to define a rigid structural unit or frame of the cutting head 40 to which the knife assemblies 50 and other components of the cutting head 40 are assembled and secured. In this manner, the camming unit 56 serves as a replacement for the fasteners 30 shown in FIG. 2 as securing the shoes 26 of the cutting head 12 to the support rings 22 and 24. FIGS. 11 and 12 represent the position of the camming member 66 in an unlocking position in which the pin 58 releases the rings 44 and 46 and shoes 48, enabling these components of the cutting head 40 to be disassembled.

Figure 14:
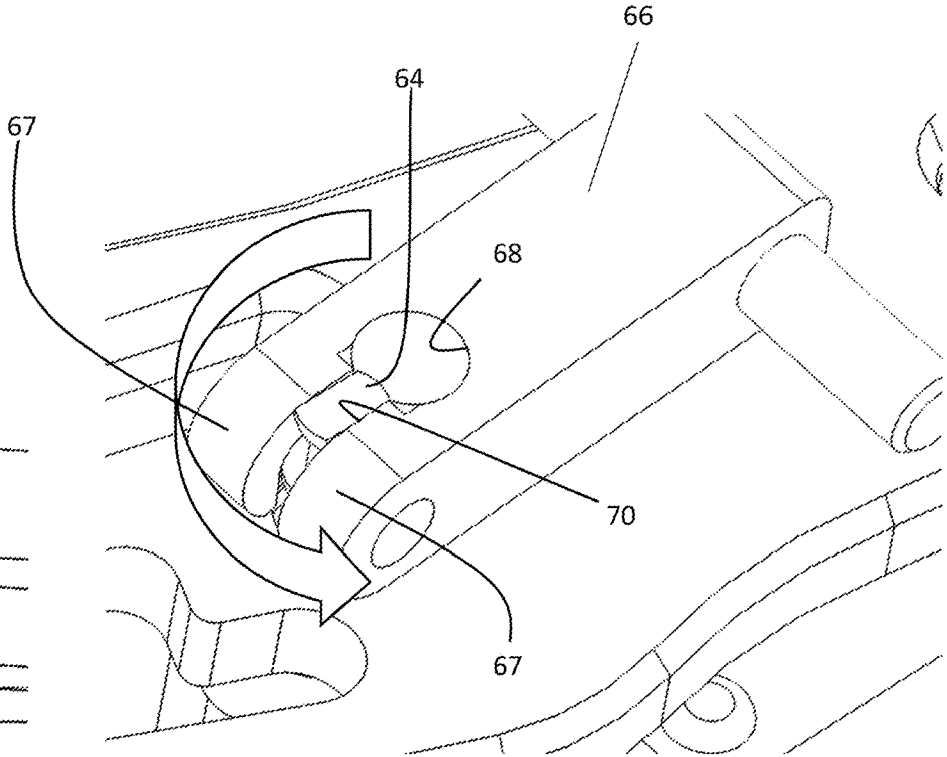
Figure 13:
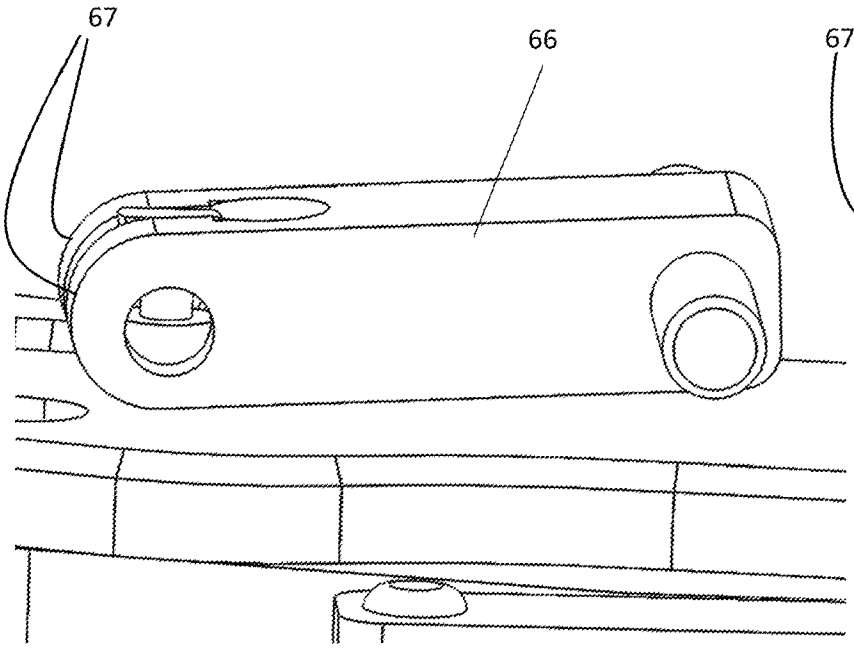

FIGS. 13 and 14 represent the position of the camming member 66 in an unlocking position in which a narrower slot 70 of the camming member 66 has captured the feature 64 of the pin 58. As seen in FIG. 14, the feature 64 and slot 70 are complementary in shape, such that the camming member 66 is not only operable to draw the pin 58 upward to lock the rings 44 and 46 and shoe 48 together, but is also operable to rotate the pin 58 about its axis of rotation. This aspect can be utilized to enable the pins 58 to not only serve as locking pins for the rings 44 and 46 and shoes 48 as part of the camming units 56, but also as adjustment pins for the knife assemblies 50 of the shoes 48 as part of an adjustment unit associated with each shoe 48.

Figure 15:
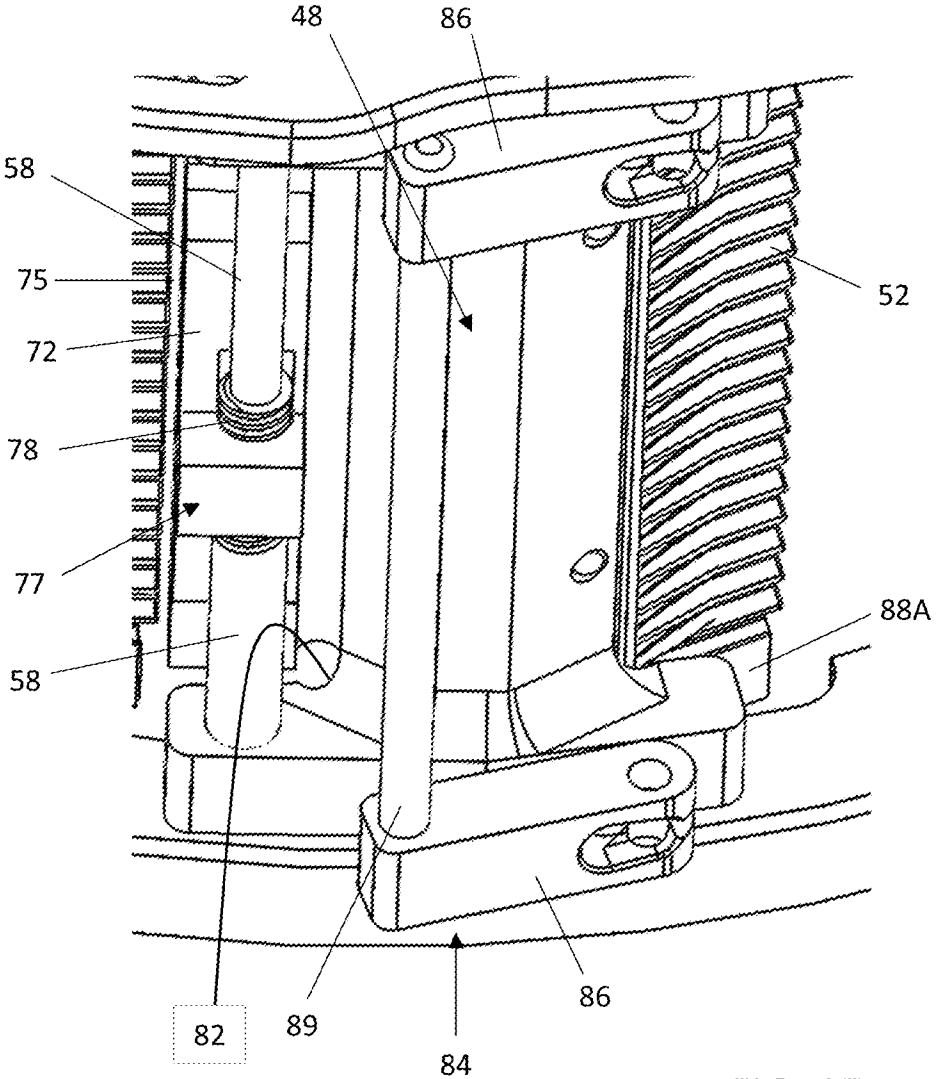
FIG. 15 is a fragmentary perspective view of an adjustment unit adapted to deflect a gate of a support segment of the cutting head of FIG. 5.
Figure 16:
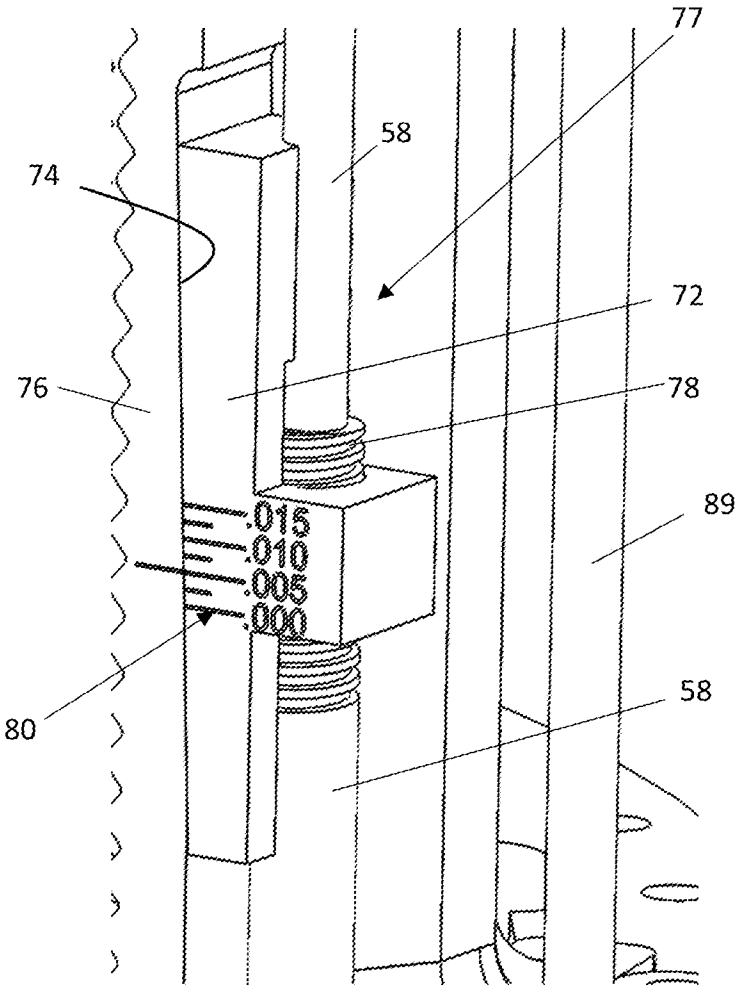
FIG. 16 is a fragmentary perspective view of a camming portion and gage of the adjustment unit of FIG. 15.

For this purpose, FIGS. 15 and 16 depict one of the pins 58 as having a wedge-shaped camming portion 72 axially disposed between the rings 44 and 46 and adapted to cam against an inclined surface 74 (FIGS. 6 and 16) formed on an outer surface region of the shoe 48 adjacent its trailing edge, such that the camming portion 72 is operable to deflect a gate 76 of the shoe 48 (FIGS. 5, 6, 7, and 16) in a radially inward direction of the cutting head 40. By deflecting the gate 76 in this manner, the pin 58 and its camming portion 72 in cooperation with the surface 74 (together constituting an adjustment unit 77) move the radial location of the trailing edge of the gate 76 relative to the cutting edge of the knife 52 (not shown) that trails the gate 76 on the cutting head 40, thereby controlling a gate opening 75 (FIG. 15) between the cutting and trailing edges that determines the thickness of a product cut with the knife 52. In this manner, the adjustment unit 77 serves as a replacement for the adjusting screw/pin 32 shown in FIG. 2. However, it is also foreseeable that the cutting head 40 could lack the adjustment unit 77 or any other adjustment feature adapted to alter the gate opening 75, and instead operate with a fixed gate opening 75.

Figure 6:
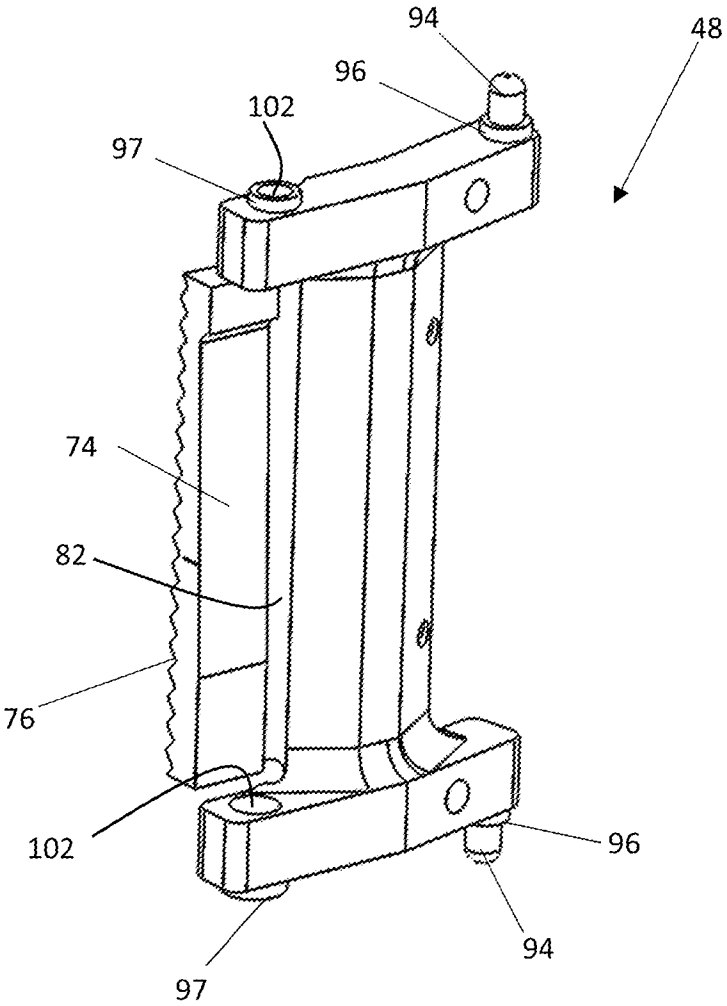

FIGS. 6 and 15 represent the shoe 48 as having a relief 82 in its outer surface region, extending in the axial direction of the cutting head 40 between the gate 76 and the leading edge of the shoe 48. The relief 82 creates a reduced-thickness section of the shoe 48 that promotes the ability of the gate 76 and its trailing edge to pivot or flex relative to the remainder of the shoe 48, including the knife 52 at its leading edge, so that the gate opening 75 defined by and between the trailing edge of the gate 76 and the cutting edge of a knife 52 immediately trailing the gate 76 can be selectively varied with the adjustment unit 77.

In the particular embodiment represented in FIGS. 15 and 16, the camming portion 72 is threadably engaged with threads 78 on the pin 58, so that rotation of the pin 58 about its axis of rotation causes the camming portion 72 to move in the axial direction of the cutting head 40 between the rings 44 and 46. The camming portion 72 and the surface 74 against which it cams are further depicted as comprising complementary features that in combination define a gage 80 with gage markings to indicate how far the gate 76 has been deflected by the camming portion 72. The graduation marks and accuracy of the gage 80 can be sufficient for producing shredded products.

Figure 20:
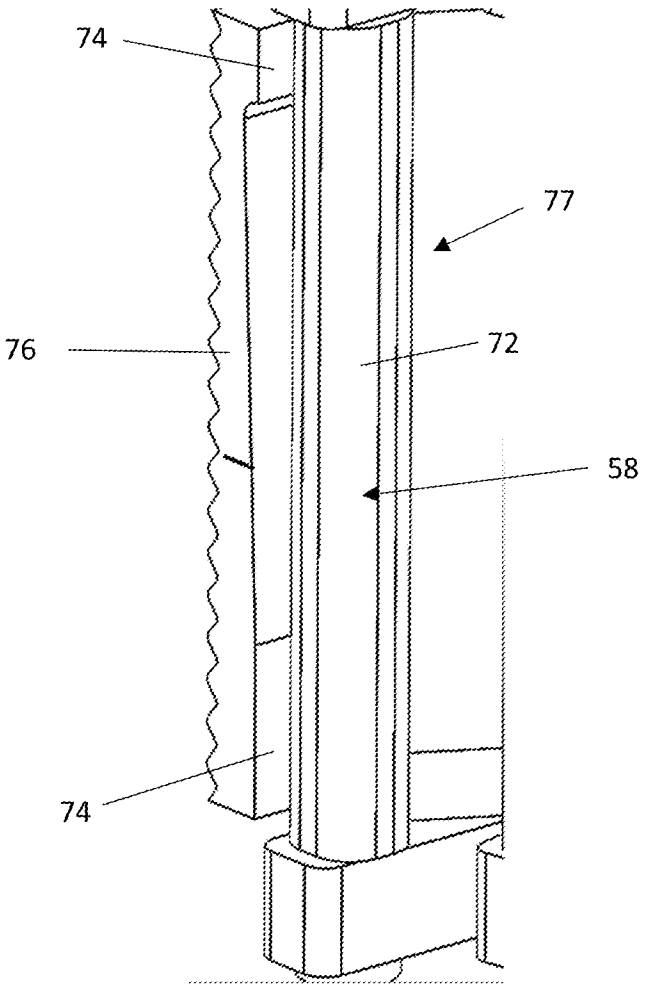
FIG. 20 is a fragmentary perspective view of an alternative adjustment unit adapted to deflect a gate of a support segment of the cutting head of FIG. 5.

FIG. 20 represents an alternative embodiment in which the camming portion 72 is an eccentric camming surface formed directly on the surface of the pin 58, so that rotation of the pin 58 about its axis of rotation causes the camming portion 72 to cam against surfaces 74 on an outer surface region of the shoe 48 adjacent the trailing edge of the shoe 48. As such, the camming portion 72 is operable to deflect the gate 76 in a radially inward direction of the cutting head 40 to alter the gate opening (not shown) defined by and between the trailing edge of the gate 76 and the cutting edge of the knife 52 (not shown) immediately trailing the gate 76.

Figure 17:
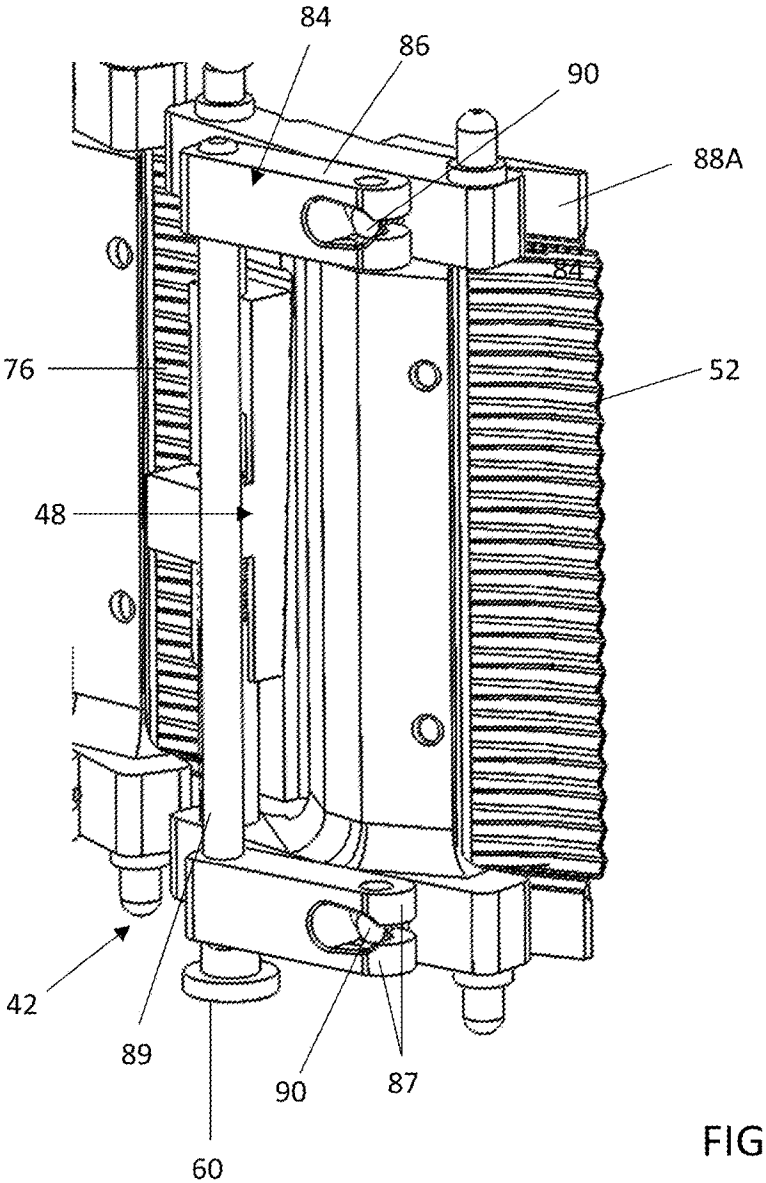
FIG. 17 is a fragmentary perspective view showing a second camming unit clamping a knife between a holder and knife support surface on a support segment.
Figure 18:
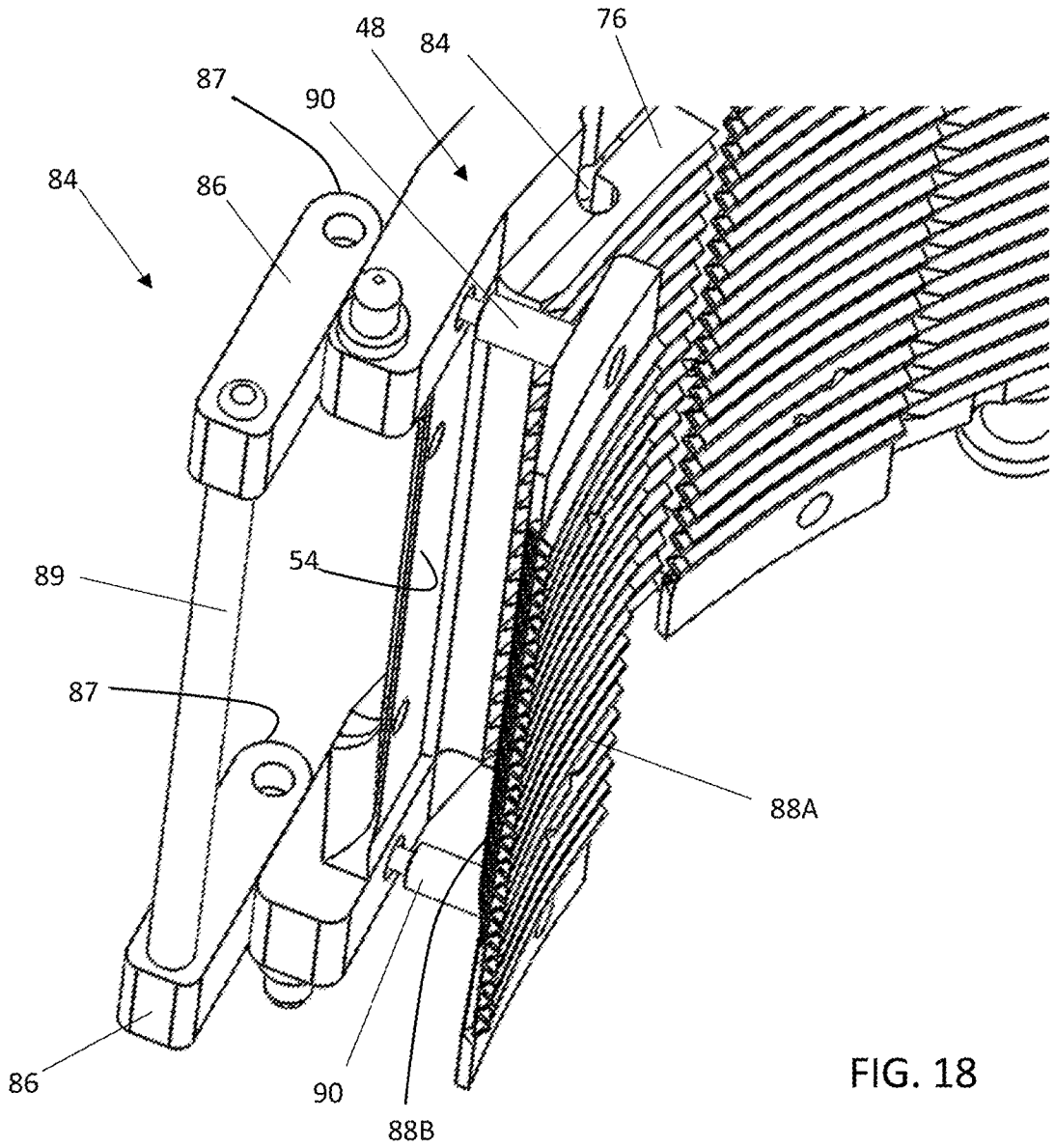
FIG. 18 is a fragmentary perspective view of the second camming unit of FIG. 17 with the knife removed from between the holder and knife support surface.
Figure 19:
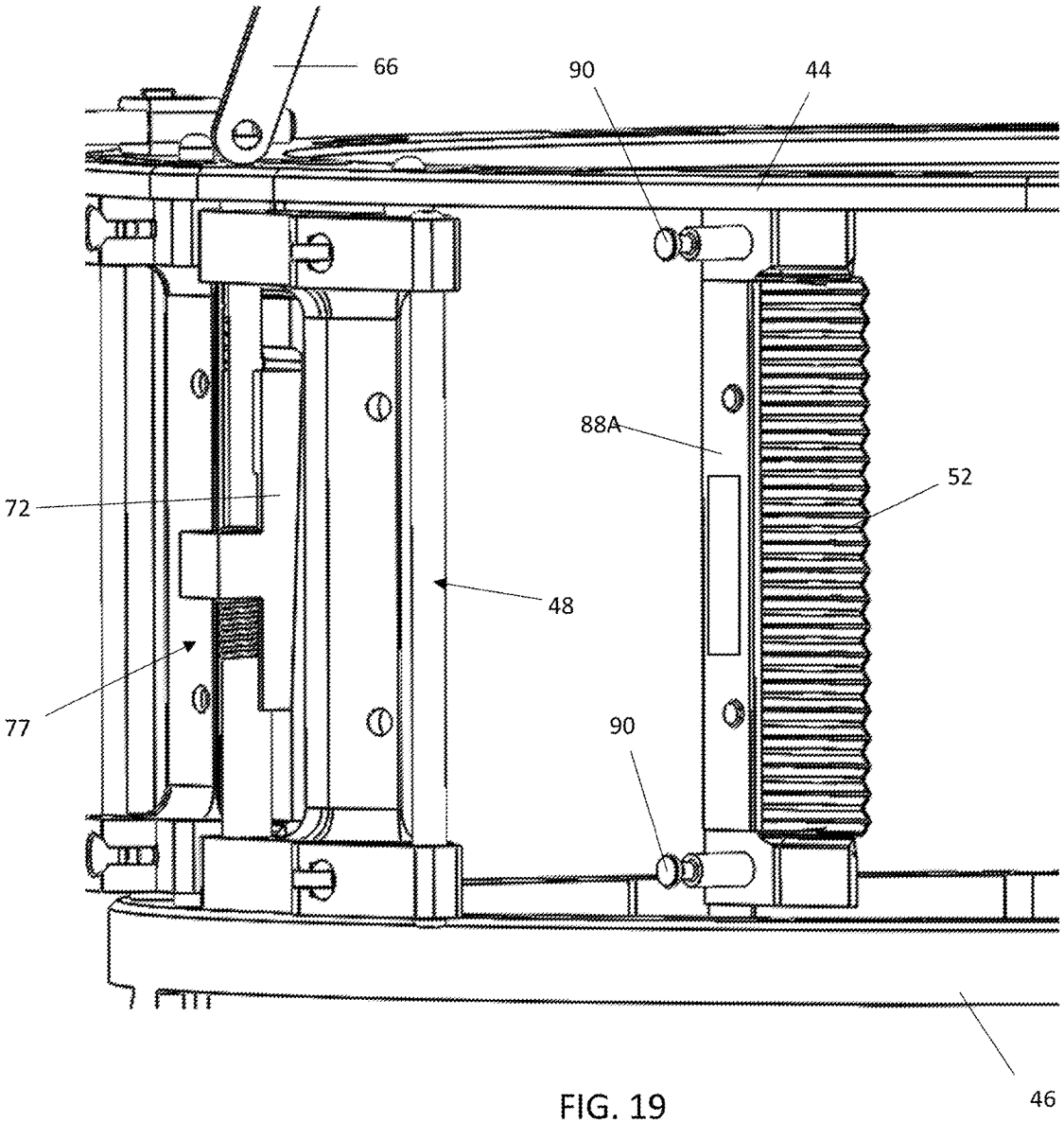
FIG. 19 is a fragmentary perspective view of the second camming unit of FIG. 15 with a support segment removed to reveal the holder.

FIG. 5 represents the cutting head 40 as further comprising an additional set of camming units 84 adapted to secure the knives 52 of the cutting units 42 within their respective knife assemblies 50. As shown in more detail in FIGS. 15 and 17-19, each camming unit 84 comprises camming members 86 located at the outer surface region of each shoe 48 and adapted to draw a knife holder 88A of the knife assembly 50 toward the knife support surface 54 of the shoe 48 to clamp the knife 52 between the knife holder 88A and a clamp 88B (FIG. 18) positioned between the knife 52 and knife support surface 54. Each camming unit 84 further comprises at least two clamping pins 90 (FIGS. 17 and 18) that each extend through the corresponding shoe 48, clamp 88B, and knife holder 88A, with one end of each clamping pin 90 engaging the knife holder 88A and an opposite second end 92 (FIG. 19) of each pin 90 protruding from the shoe 48 and engaging one of the camming members 86. Each camming member 86 pivotally engages the second end 92 of its respective clamping pin 90 and is adapted to displace the second end 92 away from the shoe 48 when pivoted relative to the clamping pin 90 so as to draw the knife holder 88A toward the shoe 48 and thereby releasably secure the knife 52 and clamp 88B between the knife holder 88A and the knife support surface 54 on the inner surface region of the shoe 48, as represented in FIGS. 15 and 17. FIG. 18 depicts the camming members 86 as having been pivoted in the opposite direction to an unlocking position, thereby releasing the knife holder 88A from the knife support surface 54 to allow removal of the knife 52 (not shown). The camming members 86 are located adjacent outer surface regions of the shoe 48 and, similar to the camming members 66 of the camming units 56, the locking and unlocking actions of the members 86 are derived from an over-center or toggle action in which a camming surface 87 of each camming member 86 bears against an outer surface region of the shoe 48 to achieve a bistable pivoting action for the member 86. To simplify the operation of the camming members 86 and promote a more uniform application of the clamping load, the camming unit 84 shown in FIGS. 15, 17 and 18 further includes a connecting bar 89 that rigidly interconnects the camming members 86 to each other. The camming units 84 of the cutting head 40 serve as replacements for fasteners 36 shown in FIGS. 2 and 3 as securing the knives 20 and clamps 28B to the knife holders 28A.

Figure 7:
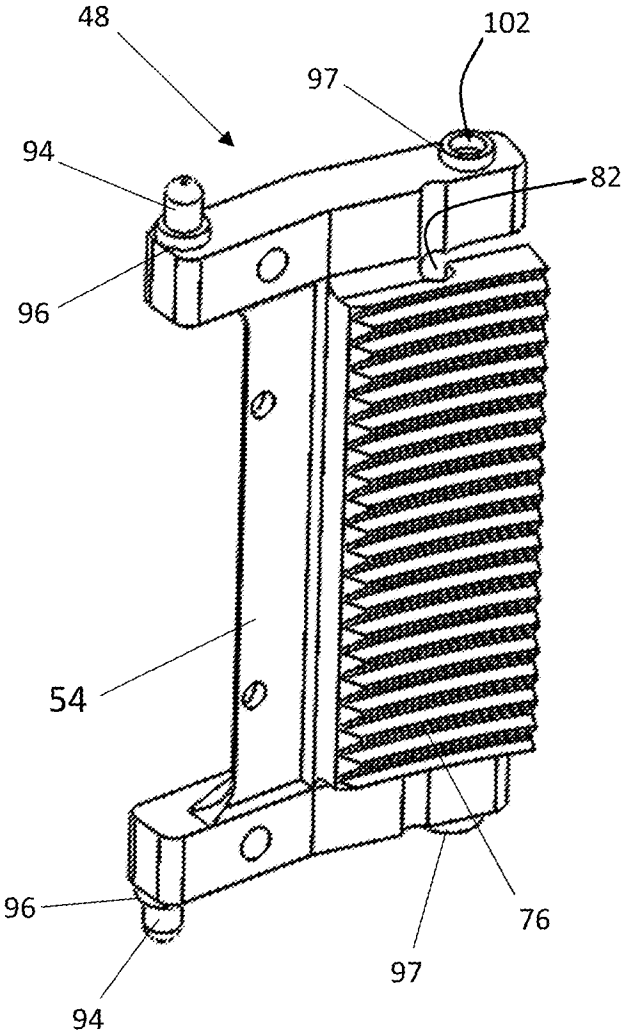
FIGS. 6 and 7 are isolated perspective views of a support segment of the cutting head of FIG. 5, and show radially outer and inner surface regions, respectively, of the support segment.
Figures 21, 22:
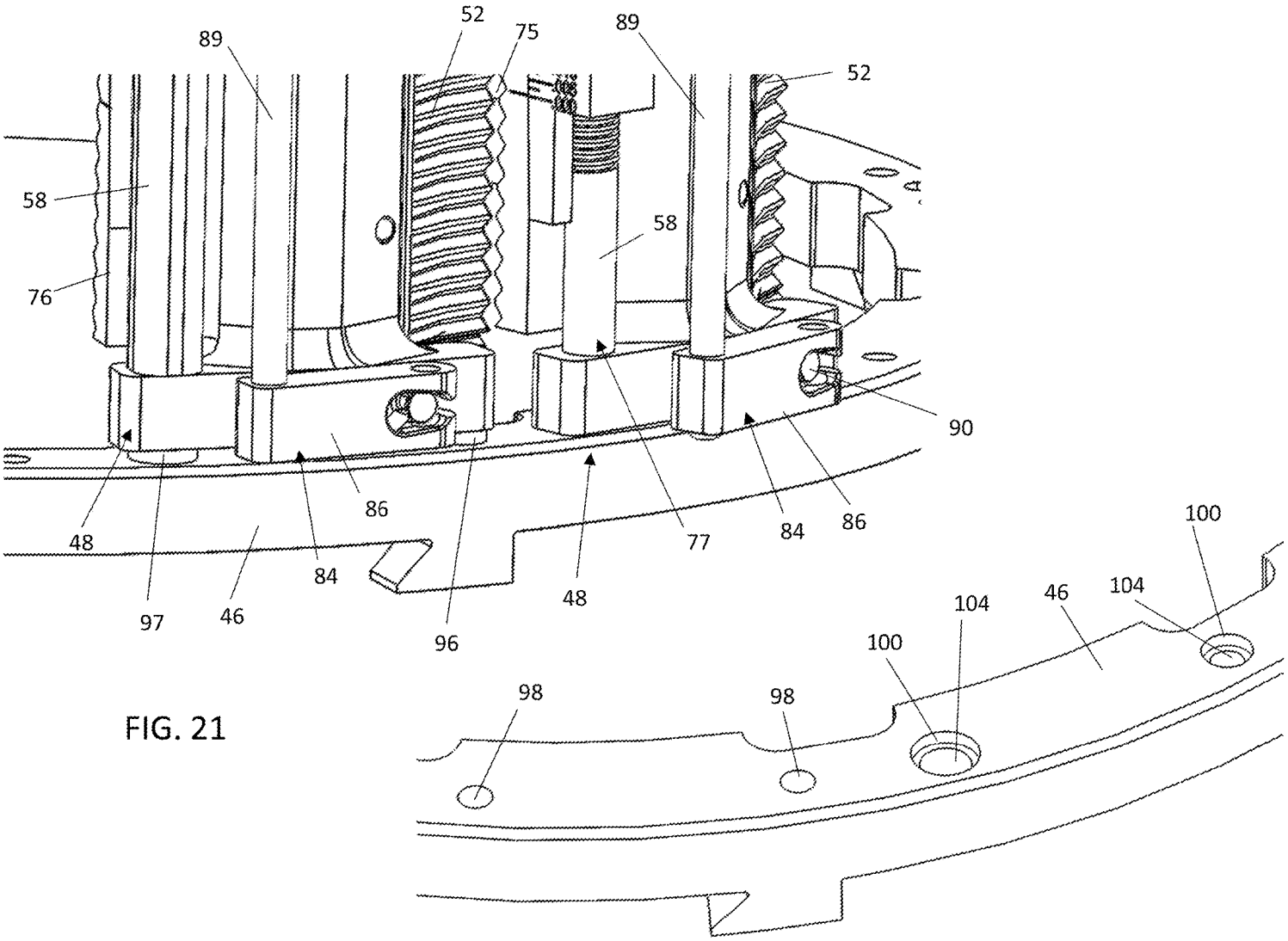
FIGS. 21 and 22 are fragmentary perspective views showing a lower support structure of the cutting head of FIG. 5.

FIGS. 6, 7, 21, and 22 represent additional nonlimiting aspects of the invention. As depicted in FIGS. 6 and 7, each shoe 48 has axially aligned pairs of pins 94 located at the leading edge thereof and adapted for engaging the rings 44 and 46 to positively locate the leading edges of the shoes 48 relative to the rings 44 and 46. Spacers 96 surround the pins 94, and additional spacers 97 are located near the trailing edge of the shoe 48. FIG. 22 is an isolated view of the lower ring 46, but is representative of the upper ring 44 as well. The rings 44 and 46 each comprise alternating sets of first and second holes 98 and 100, with the former having smaller diameters than the latter as a result of the latter being counterbored. The pins 94 are sized to be received within the smaller holes 98 and the spacers 96 and 97 are sized to be received in the larger counterbored holes 100 but not the smaller holes 98. Through-holes 104 pass through the counterbored holes 100 and, when the shoe 48 is assembled with the rings 44 and 46 with the lower pin 94 and associated spacer 96 received in one of the counterbored holes 100 of the lower ring 46, the through-hole 104 of the other counterbored hole 100 is axially aligned with one of the holes 102 formed within the spacers 97 on the shoe 48, creating a series of holes 102 and 104 through which the pin 58 passes, thereby positively locating the trailing edge of the shoe 48 relative to the rings 44 and 46. With this configuration, the shoe 48 is positioned on the lower ring 46 so that its lower pin 94 and spacers 96 and 97 are received in the larger counterbored holes 100, such that the lower surface of the shoe 48 is in direct contact with the lower ring 46. Alternatively, the shoe 48 can be selectively positioned on the lower ring 46 so that its lower pin 94 (but not its corresponding spacer 96) is received in one of the smaller holes 98 and the hole 102 through the other spacer 97 on the shoe 48 is coaxially aligned with the other smaller hole 98 of the same set on the lower ring 46, such that the spacers 96 and 97 space the lower surface of the shoe 48 apart from the lower ring 46, as shown for the lefthand shoe 48 of FIG. 21. Conversely, the upper ring 44 can be assembled with the same shoe 48 so that the upper pin 94 and its corresponding spacer 96 are received in one of the larger counterbored holes 100 and the other spacer 97 is received in the other counterbored hole 100 of the same set on the upper ring 44, such that the upper surface of the shoe 48 is in direct contact with the upper ring 44. In this manner, any shoe 48 of the cutting head 40 can be axially offset between the rings 44 and 46, as evident from the two shoes 48 seen in FIG. 21. Such an offset is desirable for offsetting the knives 52 to produce shredded products, and eliminates the need for shims to obtain the offset.

In view of similarities between the first and second embodiments of the cutting heads 40 represented in FIGS. 5 through 22 and FIGS. 23 through 40, respectively, the following discussion of the second embodiment will focus primarily on aspects of the second embodiment that differ from the first embodiment in some notable or significant manner. Other aspects of the second embodiment not discussed in any detail can be, in terms of structure, function, materials, etc., essentially as was described for the first embodiment. For convenience, identical reference numerals are used in FIGS. 23 through 40 to denote the same or functionally related/equivalent elements described for the cutting head 40 of FIGS. 5 through 22.

The cutting head 40 represented in FIGS. 23 through 40 primarily differs from the cutting head 40 of FIGS. 5 through 22 as a result of having modified locking/adjustment pins 58 (visible in FIGS. 23, 26-35, and 37-39) utilized by the camming and adjustment units 56 and 77, and the use of steps formed in the rings 44 and 46 (FIG. 40) instead of the holes 98, 100 and 104 and spacers 96 and 97 of FIGS. 6, 7, and 22 to achieve an offset function.

Regarding the modified locking/adjustment pins 58, it can be seen that the head 60 (FIG. 8) and feature 64 (FIGS. 9-14) have been modified to have hexagonal forms (visible in FIGS. 26-32), which enable the pins 58 to be rotated with the camming members 66 when not locked, but prevent rotation when the pins 58 are being tightened to prevent unintended adjustment changes. In addition, it can be seen that the camming portions 72 of the pins 58 shown in FIGS. 23, 26-35, and 37-39 correspond to that shown in FIG. 20, namely, an eccentric camming surface formed directly on each adjustment pin 58. Finally, the gages 80 used to indicate how far the gate 76 has been deflected by the camming portion 72 are now present on the circumferences of the pins 58, with the deflection indicated by the numbers on each pin 58 aligned with arrows embossed on the shoes 48.

Figure 40:
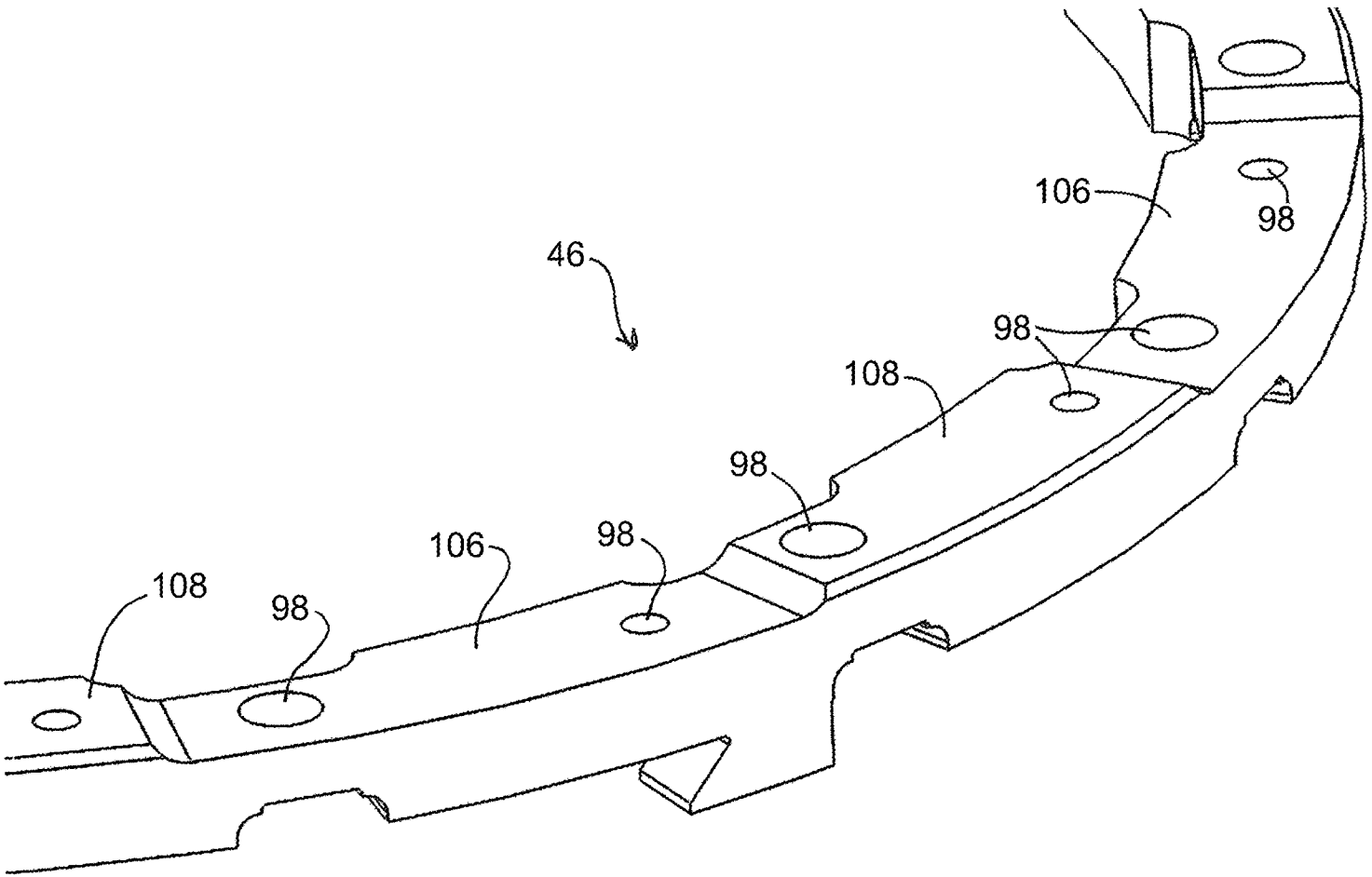

The steps formed in the rings 44 and 46 in FIG. 40 are defined by recessed surfaces 106 circumferentially spaced apart on each ring 44 and 46. Each recessed surface 106 is circumferentially between two of the raised surfaces 108, and both surfaces 106 and 108 are sized to accommodate the circumferential length of a shoe 48. As a result, adjacent shoes 48 mounted to adjacent recessed and raised surfaces 106 and 108 will be axially offset from each other, as evident from the two shoes 48 seen in FIG. 39, to produce shredded products.

While the invention has been described in terms of a particular embodiment, it should be apparent that alternatives could be adopted by one skilled in the art. For example, the machine 10, cutting head 40, impeller 14, clamping and adjustment units 56, 84, and 77, and their respective components could differ in appearance and construction from the embodiments described herein and shown in the drawings, functions of certain components could be performed by components of different construction but capable of a similar (though not necessarily equivalent) function, and various materials could be used in the fabrication of the machine 10, cutting head 40, impeller 14, clamping and adjustment units 56, 84, and 77, and their respective components. As such, it should be understood that the above detailed description is intended to describe the particular embodiments represented in the drawings and certain but not necessarily all features and aspects thereof, and to identify certain but not necessarily all alternatives to the represented embodiments and described features and aspects. As a nonlimiting example, the invention encompasses additional or alternative embodiments in which one or more features or aspects of a particular embodiment could be eliminated or two or more features or aspects of different embodiments could be combined. Accordingly, it should be understood that the invention is not necessarily limited to any embodiment described herein or illustrated in the drawings. It should also be understood that the phraseology and terminology employed above are for the purpose of describing the illustrated embodiment, and do not necessarily serve as limitations to the scope of the invention. Therefore, the scope of the invention is to be limited only by the following claims.

The invention claimed is:

1. An annular-shaped cutting head of a cutting machine, the cutting head comprising:

annular-shaped first and second structural members spaced apart in an axial direction of the cutting head;

circumferentially-spaced support segments between the first and second structural members, each of the support segments having a leading edge and an oppositely-disposed trailing edge, an inner surface region facing in a radially inward direction of the cutting head, an outer surface region facing in a radially outward direction of the cutting head, a knife support surface defined on the inner surface region adjacent the leading edge of the support segment, and a gate located adjacent the trailing edge of the support segment;

knife assemblies located adjacent the leading edge of each of the support segments, each of the knife assemblies comprising a holder opposing one of the knife support surfaces of the support segments and adapted to clamp a knife between the holder and the knife support surface;

wherein the cutting head further comprises at least one of the following:

first camming units engaging the first and second structural members and adapted to draw the first and second structural members together to releasably secure the support segments therebetween;

second camming units located at the outer surface regions of the support segments and adapted to draw the holders of the knife assemblies toward a corresponding one of the knife support surfaces to clamp a knife between the holder and the knife support surface; and adjustment units each comprising an adjustment pin engaging the first and second structural members and a camming portion adapted to cam against the outer surface region of a corresponding one of the support segments adjacent the trailing edges of the support segment to deflect the gate of the support segment in the radially inward direction of the cutting head.

2. The annular-shaped cutting head according to claim 1, wherein the cutting head comprises the first camming units, each of the first camming units comprising:

a locking pin that extends between and through the first and second structural members, the locking pin having a first end engaging the first structural member and a second end protruding from the second structural member; and a camming member located at the second structural member, pivotally engaging the second end of the locking pin, and adapted to displace the second end of the locking pin away from the second structural member when pivoted relative to the locking pin so as to draw the first structural member toward the second structural member and thereby releasably secure the support segments therebetween.

3. The annular-shaped cutting head according to claim 2, wherein each of the locking pins has an axis of rotation, the first and second ends of each locking pin are at oppositely-disposed axial ends of the locking pin, and the camming member and the second end of the locking pin of each of the first camming units have complementary features enabling the locking pins to be rotated with the camming members about the axes of rotation thereof.

4. The annular-shaped cutting head according to claim 3, wherein the locking pins are also the adjustment pins that engage the first and second structural members, each of the camming portions is between the first and second structural members, and rotation of one of the locking pins about the axis of rotation thereof causes the camming portion thereof to cam against the outer surface region of a corresponding one of the support segments to deflect the gate thereof in the radially inward direction of the cutting head.

5. The annular-shaped cutting head according to claim 4, wherein the camming portions define eccentric camming surfaces and rotation of the locking pins about the axes of rotation thereof causes the camming portions thereof to move in the axial direction of the cutting head between the first and second structural members.

6. The annular-shaped cutting head according to claim 4, wherein rotation of one of the locking pins about the axis of rotation thereof causes the camming portion thereof to move in the axial direction of the cutting head between the first and second structural members, and the outer surface region of each of the support segments comprises an inclined surface against which the camming portion of a corresponding one of the locking pins cams to deflect the gates in the radially inward direction of the cutting head.

7. The annular-shaped cutting head according to claim 6, wherein the camming portions of the locking pins are threadably mounted to the locking pins so that the rotation of the locking pins cause the camming portions thereof to move in the axial direction of the cutting head.

8. The annular-shaped cutting head according to claim 7, further comprising complementary features on the camming portions and the outer surface regions of the support segments that in combination define a gage indicating how far the gates are deflected in the radially inward direction of the cutting head.

9. The annular-shaped cutting head according to claim 2, wherein each of the camming members has a camming surface that cams against the second structural member.

10. The annular-shaped cutting head according to claim 2, wherein each of the support segments has a relief in the outer surface region thereof between the leading edge and the gate thereof that enables the gate and the trailing edge of the support segment to pivot relative to the leading edge of the support segment.

11. The annular-shaped cutting head according to claim 1, wherein the cutting head comprises the adjustment units, each of the adjustment pins comprises an axis of rotation and first and second ends at oppositely-disposed axial ends of the adjustment pin, the first end engages the first structural member, the second end protrudes from the second structural member, and each of the adjustment units comprises:

a member located at the second structural member; and complementary features on the member and the second end of the adjustment pin that enable the adjustment pin to be rotated with the member about the axis of rotation thereof.

12. The annular-shaped cutting head according to claim 11, wherein rotation of each of the adjustment pins about the axis of rotation thereof causes the camming portion thereof to cam against the outer surface region of a corresponding one of the support segments to deflect the gate thereof in the radially inward direction of the cutting head.

13. The annular-shaped cutting head according to claim 12, wherein the camming portion of each of the adjustment units is between the first and second structural members, and rotation of one of the adjustment pins about the axis of rotation thereof causes the camming portion thereof to move in the axial direction of the cutting head between the first and second structural members.

14. The annular-shaped cutting head according to claim 13, wherein the outer surface region of each of the support segments comprises an inclined surface against which the camming portion of a corresponding one of the adjustment units cams to deflect the gates in the radially inward direction of the cutting head.

15. The annular-shaped cutting head according to claim 14, wherein the camming portions of the adjustment units are threadably mounted to the adjustment pins so that the rotation of the adjustment pins cause the camming portions thereof to move in the axial direction of the cutting head.

16. The annular-shaped cutting head according to claim 15, further comprising complementary features on the camming portions and the outer surface regions of the support segments that in combination define a gage indicating how far the gates are deflected in the radially inward direction of the cutting head.

17. The annular-shaped cutting head according to claim 11, wherein each of the support segments has a relief in the outer surface region thereof between the leading edge and the gate thereof that enables the gate and the trailing edge of the support segment to pivot relative to the leading edge of the support segment.

18. The annular-shaped cutting head according to claim 1, wherein the cutting head comprises the second camming units, each of the second camming units comprising:

first and second clamping pins that each extend through a corresponding one of the support segments, each of the first and second clamping pins having a first end engaging the holder and a second end protruding from the support segment; and first and second camming members located at the support segment, pivotally engaging the second ends of respectively the first and second clamping pins, and adapted to displace the second ends of the clamping pins away from the support segment when pivoted relative to the clamping pins so as to draw the holder toward the support segment and thereby releasably secure a knife therebetween.

19. The annular-shaped cutting head according to claim 18, wherein the first and second camming members having camming surfaces that cam against the support segment.

20. The annular-shaped cutting head according to claim 1, wherein each of the first and second structural members comprises alternating sets of first and second holes, the first holes have smaller diameters than the second holes, and each of the support segments comprises:

location pins and first spacers surrounding the location pins, the location pins being sized to be received within the first holes and the first spacers being sized to be received in the second holes but not the first holes; and second spacers sized to be received within the second holes) but not the first holes;

whereby the first and second spacers are operable to selectively position the support segments on the first and second structural members to axially offset adjacent pairs of the support segments between the first and second structural members.

21. The annular-shaped cutting head according to claim 1, further comprising steps defined in the first and second structural members by recessed surfaces circumferentially spaced apart on each of the first and second structural members, each of the recessed surfaces being between two raised surfaces, the recessed and raised surfaces individually being sized to accommodate a circumferential length of one of the support segments, whereby adjacent pairs of the support segments mounted to adjacent pairs of the recessed and raised surfaces are axially offset from each other.

22. The annular-shaped cutting head according to claim 1, wherein each of the support segments has an axially aligned pair of pins located at the leading edge thereof and engaging the first and second structural members to positively locate the leading edges of the support segments relative to the first and second structural members.

23. The annular-shaped cutting head according to claim 1, wherein an impeller is coaxially mounted within the cutting head for rotation about an axis of the cutting head in a rotational direction relative to the cutting head.

24. The annular-shaped cutting head according to claim 1, further comprising a knife between each corresponding pair of the holders of the knife assemblies and the knife support surfaces of the support segments, each knife having a cutting edge disposed adjacent one of the gates of a preceding one of the support segments so as to define a gate opening between the cutting edge of the knife and the trailing edge of the preceding support segment.

25. A cutting machine in which the annular-shaped cutting head of claim 1 is installed, the cutting machine further comprising an impeller coaxially mounted within the cutting head for rotation about an axis of the cutting head in a rotational direction relative to the cutting head.

26. The cutting machine of claim 25, wherein the cutting machine is a centrifugal-type cutting machine.

27. A method of assembling the cutting head of claim 1 by operating the first camming units to draw the first and second structural members together to secure the support segments therebetween.

28. A method of disassembling the cutting head of claim 1 by operating the first camming units to release the support segments from between the first and second structural members.

29. A method of assembling the cutting head of claim 1 by operating the second camming units to draw the holders of the knife assemblies toward the knife support surfaces to clamp knives between the holders and the knife support surface.

30. A method of disassembling the cutting head of claim 1 by operating the second camming units to release the knives from between the holders and the knife support surfaces.

31. A method of adjusting the cutting head of claim 1 by rotating the adjustment pins to deflect the gates of the support segments in the radially inward direction of the cutting head.

* * * * *